US010457510B2

(12) United States Patent
Kanemaru et al.

(10) Patent No.: US 10,457,510 B2
(45) Date of Patent: Oct. 29, 2019

(54) RECORDING APPARATUS

(71) Applicant: SEIKO EPSON CORPORATION, Tokyo (JP)

(72) Inventors: Shinji Kanemaru, Matsumoto (JP); Kazuhisa Nakamura, Matsumoto (JP); Tatsuya Shirane, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/987,988

(22) Filed: May 24, 2018

(65) Prior Publication Data

US 2018/0346267 A1 Dec. 6, 2018

(30) Foreign Application Priority Data

May 30, 2017 (JP) ..... 2017-106726

(51) Int. Cl.

| | |
|---|---|
| ***B65H 3/56*** | (2006.01) |
| ***B65H 3/06*** | (2006.01) |
| ***B65H 1/02*** | (2006.01) |
| ***B65H 3/52*** | (2006.01) |
| ***B65H 5/06*** | (2006.01) |

(52) U.S. Cl.

CPC ..... *B65H 3/565* (2013.01); *B65H 1/027* (2013.01); *B65H 3/0661* (2013.01); *B65H 3/0669* (2013.01); *B65H 3/5215* (2013.01); *B65H 5/062* (2013.01); *B65H 2402/31* (2013.01); *B65H 2402/46* (2013.01); *B65H 2403/421* (2013.01); *B65H 2403/512* (2013.01); *B65H 2404/144* (2013.01); *B65H 2405/211* (2013.01)

(58) Field of Classification Search

CPC ..... B65H 3/50; B65H 3/5246; B65H 3/56; B65H 3/565

USPC ..... 271/122

See application file for complete search history.

(56) References Cited

U.S. PATENT DOCUMENTS 5,725,208 A * 3/1998 Miyauchi ..... B41J 13/103 271/10.09
5,882,004 A * 3/1999 Padget ..... B65H 3/0607 271/119
6,059,281 A 5/2000 Nakamura et al.
(Continued)

FOREIGN PATENT DOCUMENTS

JP 10-236680 A 9/1998
JP 2004-083168 A 3/2004
(Continued)

*Primary Examiner* — Michael C McCullough
(74) *Attorney, Agent, or Firm* — Workman Nydegger

(57) ABSTRACT

A recording apparatus includes a return member switchable between a first orientation in which a portion of the return member overlaps a feed roller in a side view of a medium feeding path and a second orientation in which the return member is turned toward a downstream side in a medium feeding direction and does not overlap the feed roller. The return member changes an orientation thereof from the second orientation to the first orientation, thereby returning a medium to an upstream side in the medium feeding direction. When a transport roller disposed downstream of the feed roller is driven in reverse to return the medium to the upstream side and position the medium at a recording start position, the return member takes a third orientation in which the return member is raised toward the upstream side further than in the first orientation.

7 Claims, 20 Drawing Sheets

(56) References Cited

U.S. PATENT DOCUMENTS

| | | | | |
|---|---|---|---|---|
| 6,217,017 | B1 * | 4/2001 | Yamazaki | B65H 3/5223 271/121 |
| 6,663,098 | B2 * | 12/2003 | Teo | B65H 3/0661 271/119 |
| 6,824,132 | B2 * | 11/2004 | Asai | B65H 3/5261 271/117 |
| 6,877,737 | B2 * | 4/2005 | Yanagi | B41J 13/103 271/121 |
| 6,877,738 | B2 * | 4/2005 | Sonoda | B65H 3/0607 271/121 |
| 6,978,113 | B2 * | 12/2005 | Kamimura | G03G 15/6564 399/388 |
| 7,165,765 | B2 * | 1/2007 | Sonoda | B41J 13/103 271/122 |
| 7,484,724 | B2 * | 2/2009 | Yamanaka | B41J 13/103 271/121 |
| 7,641,187 | B2 * | 1/2010 | Sonoda | B65H 3/5223 271/119 |
| 7,942,518 | B2 * | 5/2011 | Ogimura | B41J 13/103 347/104 |
| 2007/0019055 | A1 * | 1/2007 | Miyake | B41J 13/103 347/104 |
| 2008/0185775 | A1 * | 8/2008 | Okuno | B65H 3/0607 271/275 |
| 2008/0185776 | A1 * | 8/2008 | Okuno | B65H 3/0607 271/275 |

FOREIGN PATENT DOCUMENTS

| | | | |
|---|---|---|---|
| JP | 2007-119190 | A | 5/2007 |
| JP | 2015-157681 | A | 9/2015 |

* cited by examiner

RECORDING APPARATUS

BACKGROUND

1. Technical Field

The present invention relates to a recording apparatus that performs recording on a medium.

2. Related Art

An ink jet printer, as an example of the recording apparatus, includes a feeding device (automatic sheet feeder (ASF)) in which a plurality of sheets can be set as media (objects onto which recording is performed). Such a feeding device includes a hopper that supports a sheet; a feed roller that feeds the sheet to a downstream side by coming into contact with the sheet and rotating; a separation roller that nips, between the separation roller and the feed roller, the sheet to be fed to separate the sheet to be fed from subsequent sheets overlapping the sheet to be fed and attempting to be fed together with the sheet to be fed; and a return lever that returns the subsequent sheets separated by the separation roller to an upstream side (hopper) (refer to, for example, JP-A-2004-83168).

In recent years, despite a requirement to reduce a product size, there is a requirement to maintain or even increase the number of sheets that can be set in a feeding device. In addition, there is a requirement to increase the number of sheets that can be set in the feeding device while maintaining product size. As a result, there is a circumstance in which it is necessary to reduce a space between a feed roller and an uppermost sheet of set sheets of the maximum stacking number.

In one configuration of a feeding device, a leading end of a sheet is sometimes positioned ahead of a recording start position after completion of a series of feeding operations. In such a case, in order to position the sheet at the recording start position, it is necessary to back-feed the sheet by rotating a transport roller disposed downstream of the feeding device in reverse. After the feeding operations, the hopper is lowered when the transport roller starts transporting the sheet, and a sheet-return lever performs a sheet returning operation. At this time, the feed roller is freely rotatable in a reverse rotation direction. Due to the lowered hopper, the set sheets are moved to a position at which the sheets do not come into contact with the feed roller. The set sheets, however, may come into contact with the feed roller and may obstruct free rotation of the feed roller if a space between the feed roller and the uppermost sheet of the sheets set on the feeding device is small. When the rotation of the feed roller is obstructed, the feed roller may obstruct back-feeding of the sheet, which may lead to creasing and jamming of the sheet to be back-fed.

SUMMARY

An advantage of some aspects of the invention is that a recording apparatus capable of performing appropriate sheet transporting, even when a space between a set sheet and a feed roller is small, is provided.

A recording apparatus according to an aspect of the invention includes a medium support unit that supports a medium to be fed; a cylindrical feed roller that feeds the medium supported by the medium support unit; a motive power transmitting unit that transmits a driving force from a driving source of the feed roller to the feed roller; a separation roller that separates the medium by nipping the medium between the separation roller and the feed roller; a return member that is switchable between a first orientation and a second orientation, the first orientation being an orientation in which a portion of the return member overlaps the feed roller in a side view of a medium feeding path, the second orientation being an orientation in which the return member is turned toward a downstream side in a medium feeding direction and does not overlap the feed roller in the side view, the return member changing an orientation thereof from the second orientation to the first orientation and thereby returning a leading end of the medium to an upstream side of a nip position between the feed roller and the separation roller; a transport roller that is disposed on the downstream side of the feed roller in the medium feeding direction, the transport roller being rotatable in a normal direction and in a reverse direction; and a control unit that controls the transport roller. The motive power transmitting unit is capable of entering a rotation allowing state by cutting torque transmission from the driving source to the feed roller, the rotation allowing state being a state in which free rotation of the feed roller is allowed. The return member is switchable to a third orientation, the third orientation being an orientation in which the return member is raised toward the upstream side further than in the first orientation. The control unit drives the transport roller in reverse when the return member is in the third orientation during positioning control that is a control in which the transport roller is driven in reverse to return the medium to the upstream side and position the medium at a recording start position.

The motive power transmitting unit, which transmits the driving force from the driving source to the feed roller, is capable of entering the rotation allowing state, in which the free rotation of the feed roller is allowed, by cutting the torque transmission from the driving source to the feed roller; thus, when the medium is back-fed, the medium and the feed roller come into contact with each other, and the feed roller is freely rotatable by a predetermined degree.

The return member, which returns the medium to the upstream, is switchable to the third orientation, in which the return member is raised toward the upstream side further than in the first orientation in the side view of the medium feeding path; thus, the set medium can be separated from the feed roller by the return member switching to the third orientation.

Moreover, according to the aspect, the control unit, which controls the transport roller, drives the transport roller in reverse when the return member is in the third orientation; thus, it is possible to prevent the set medium from coming into contact with the feed roller and obstructing the free rotation of the feed roller, which enables appropriate back-feeding of the medium.

Accordingly, it is possible to perform appropriate medium transporting even when the space between the set medium and the feed roller is small.

In the recording apparatus, the return member in the third orientation may not overlap the feed roller in the side view of the medium feeding path.

In this case, it is possible to reduce a transporting load applied by the return member to the medium to be back-fed because the return member in the third orientation does not overlap the feed roller in the side view of the medium feeding path.

In the recording apparatus, in a state in which a stacking height of media set on the medium support unit has reached a maximum stacking height and in which the return member is in the first orientation, an uppermost medium of the media set on the medium support unit is allowed to come into contact with the feed roller.

In this case, it is possible to reduce the space between the medium and the feed roller, and thus it is possible to reduce the size of the apparatus because in the state in which the stacking height of the media set on the medium support unit has reached the maximum stacking height and in which the return member is in the first orientation, the uppermost medium of the media set on the medium support unit is allowed to come into contact with the feed roller.

The recording apparatus may further include an edge guide that restricts a position of an edge of the medium supported by the medium support unit. The edge guide includes a protruding portion that restricts the maximum stacking height of the media set on the medium support unit.

In this case, it is possible to prevent setting of the media of a quantity exceeding a limit and to ensure the aforementioned operational effect in the aspect because there is provided the edge guide that restricts the position of the edge of the medium supported by the medium support unit, and the edge guide includes the protruding portion that restricts the maximum stacking height of the media set on the medium support unit.

In the recording apparatus, the medium support unit may include a first support portion having a first support surface that supports the medium in an inclined orientation and a second support portion having a second support surface that supports the medium in cooperation with the first support surface. The second support portion is positioned on the upstream side of the first support surface in the medium feeding direction. An inclination angle of the second support surface extending from a lower end portion to an upper end portion thereof is larger than an inclination angle of the first support surface. The second support surface is disposed at a position set back from the first support surface.

In this case, the second support surface is disposed on the upstream side of the first support surface in the medium feeding direction, and a step is formed between the first support surface and the second support surface. Thus, when a medium having high rigidity is set, a trailing end of the medium may not easily come into contact with the second support surface, which enables the medium to be in an orientation more similar to that of the first support surface. Therefore, it is possible to prevent the medium from having an inappropriate inclined orientation and to achieve appropriate feeding.

With respect to a medium having low rigidity, the entry angle thereof in a direction from the first support surface toward the downstream side is appropriately regulated by the first support surface because such a medium tends to be in an orientation similar to that of each of the first support surface and the second support surface. As a result, it is also possible to obtain a good feeding result.

Moreover, it is possible to reduce an installation space required on the rear side of the apparatus because the inclination angle of the second support surface is larger than that of the first support surface.

Therefore, it is possible to form an appropriate orientation of the medium regardless of the rigidity of the medium and to reduce the installation space of the apparatus.

In the recording apparatus, when the medium is back-fed, a relative-movement direction of the medium relative to an outer circumferential surface of the feed roller and a direction in which the outer circumferential surface of the feed roller is ground may coincide with each other.

In this case, the medium to be back-fed is not conflict with a surface state, which is formed due to grinding, of the outer circumferential surface of the feed roller because the relative-movement direction of the medium relative to the outer circumferential surface of the feed roller and the direction in which the outer circumferential surface of the feed roller is ground coincide with each other when the medium is back-fed. Therefore, it is possible to reduce the transporting load applied by the feed roller to the medium to be back-fed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
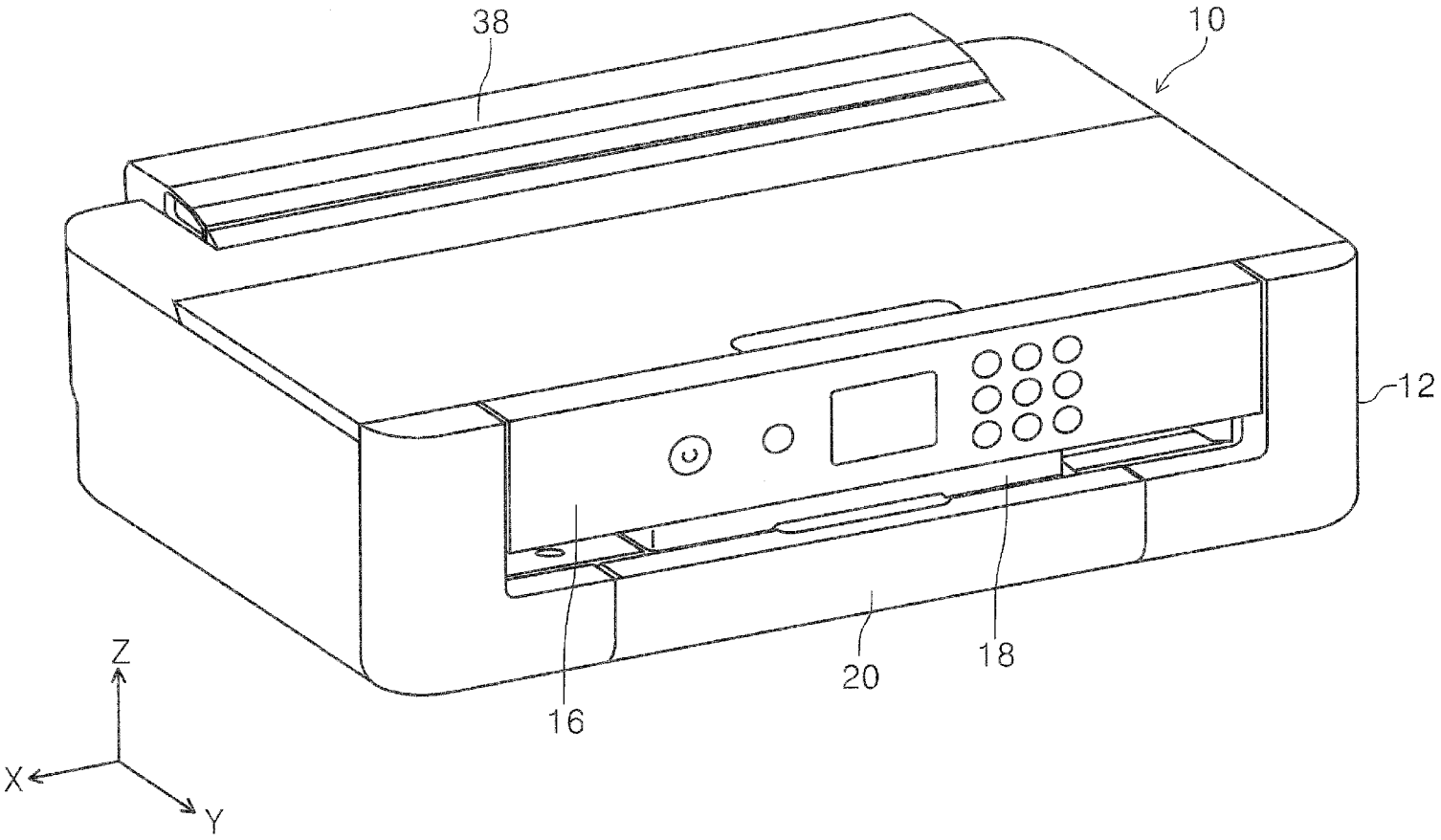
FIG. 1 is a perspective view of an appearance of a printer according to the present invention.

An exemplary embodiment of the invention will be described below with reference to the drawings. Note that like elements are given like reference numerals in examples and that only the like elements in a first example will be described, and description of the like elements in other examples will be omitted.

Figure 2:
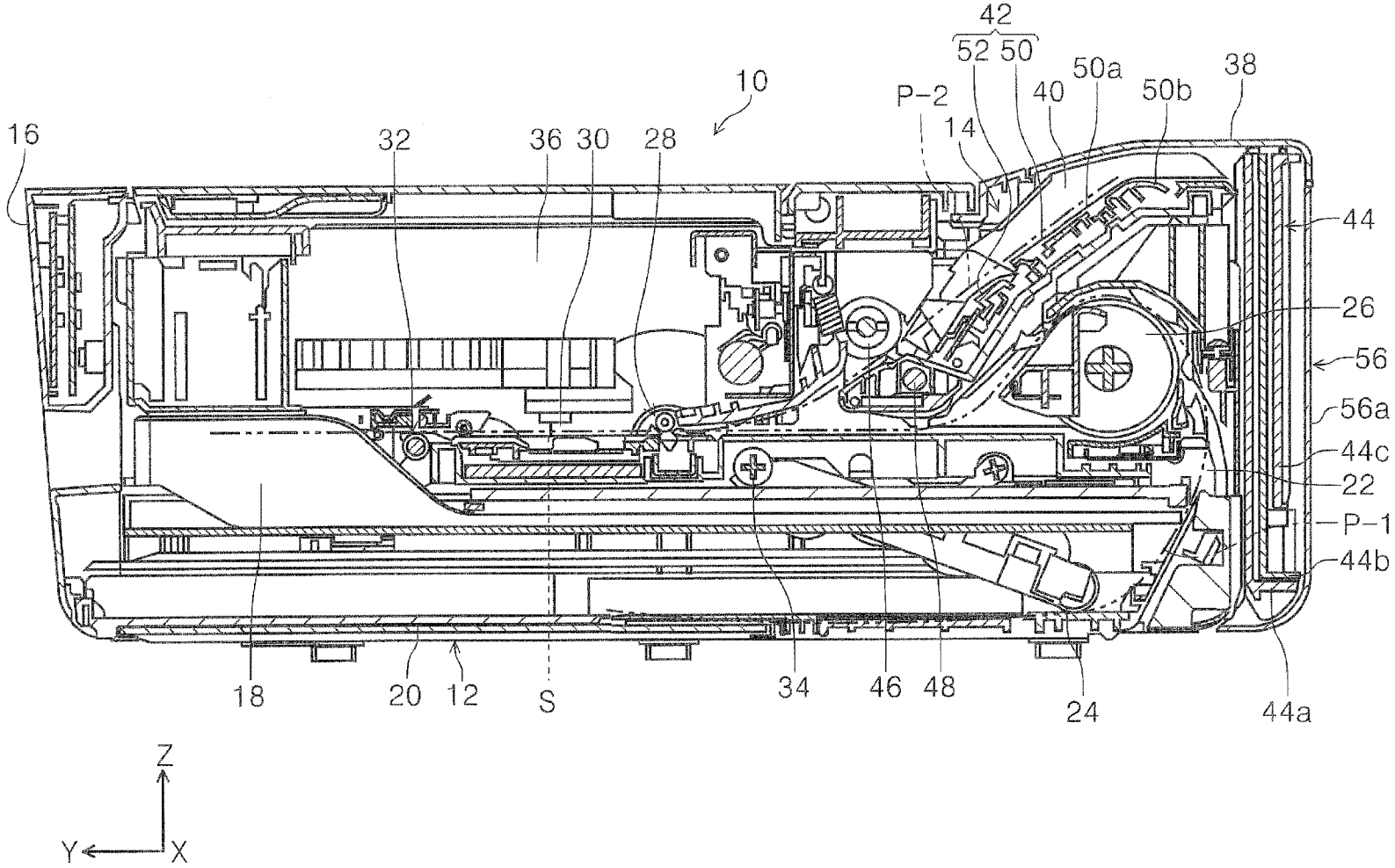
FIG. 2 is a side sectional view illustrating a medium-transport path of the printer according to the invention.
Figure 3:
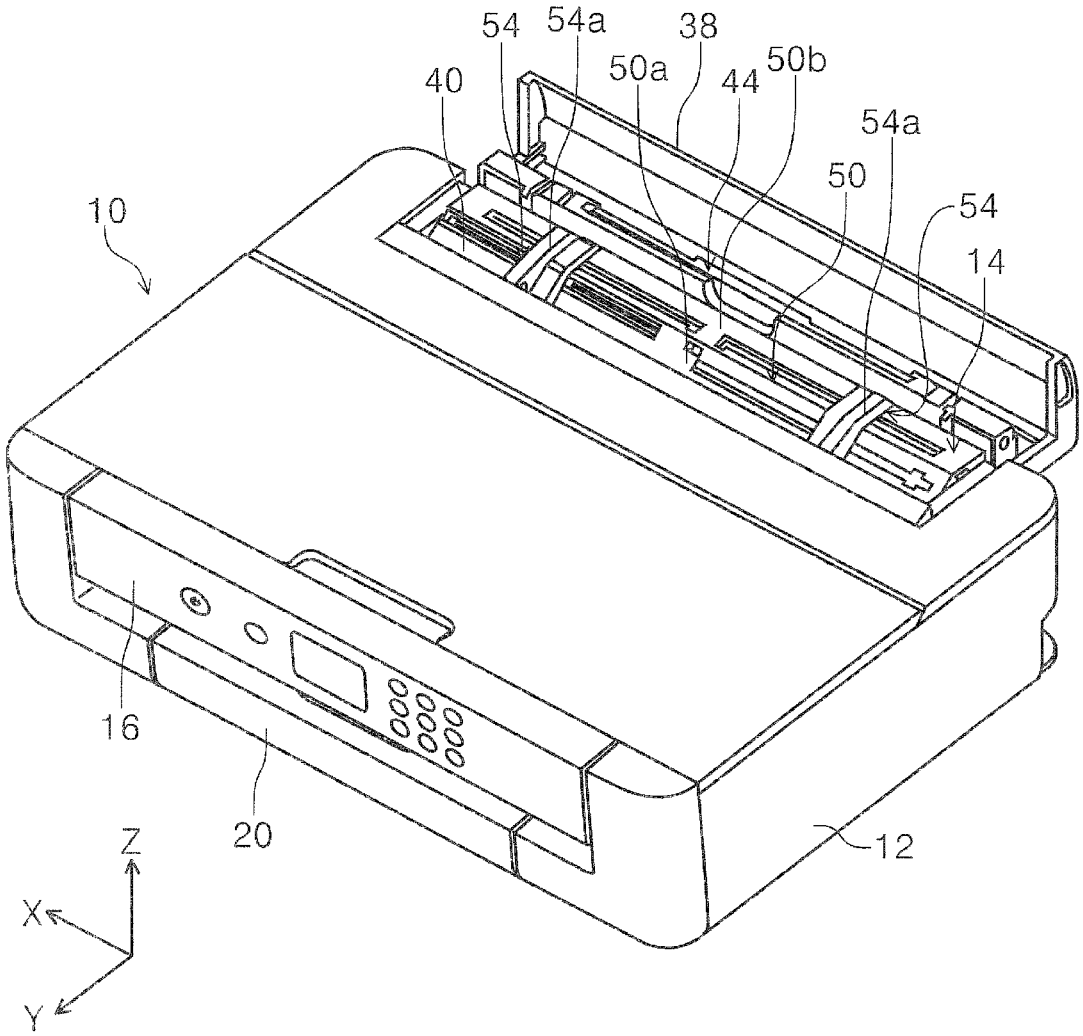
FIG. 3 is a perspective view of the appearance of the printer in a state in which a cover is open.
Figure 4:
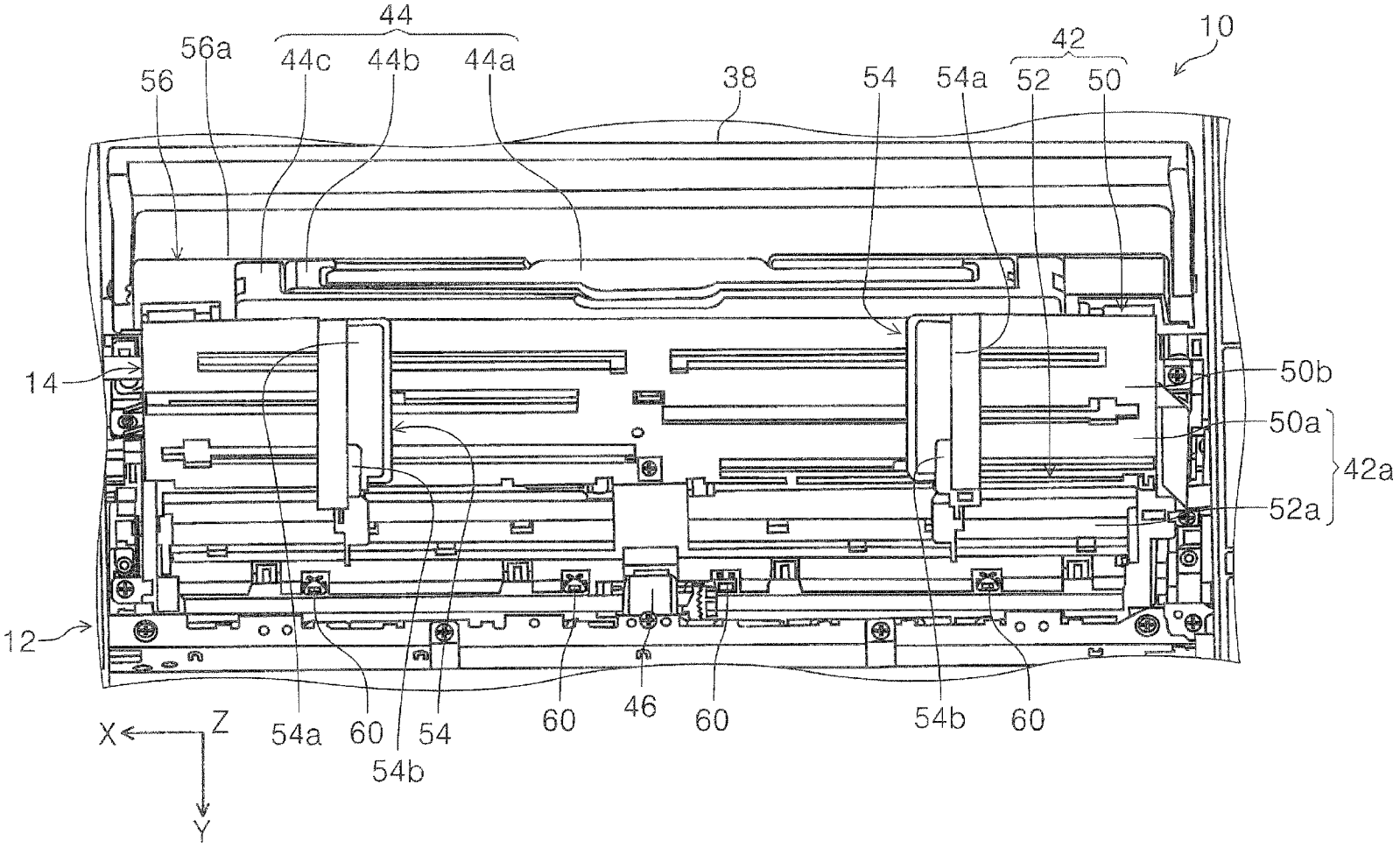
FIG. 4 is a plan view illustrating a first support portion and edge guides in the state in which the cover is open.

FIG. 1 is a perspective view of an appearance of a printer according to the present invention. FIG. 2 is a side sectional view illustrating a medium-transport path of the printer according to the invention. FIG. 3 is a perspective view of the appearance of the printer in a state in which a cover is open. FIG. 4 is a plan view illustrating a first support portion and edge guides in the state in which the cover is open.

Figure 5:
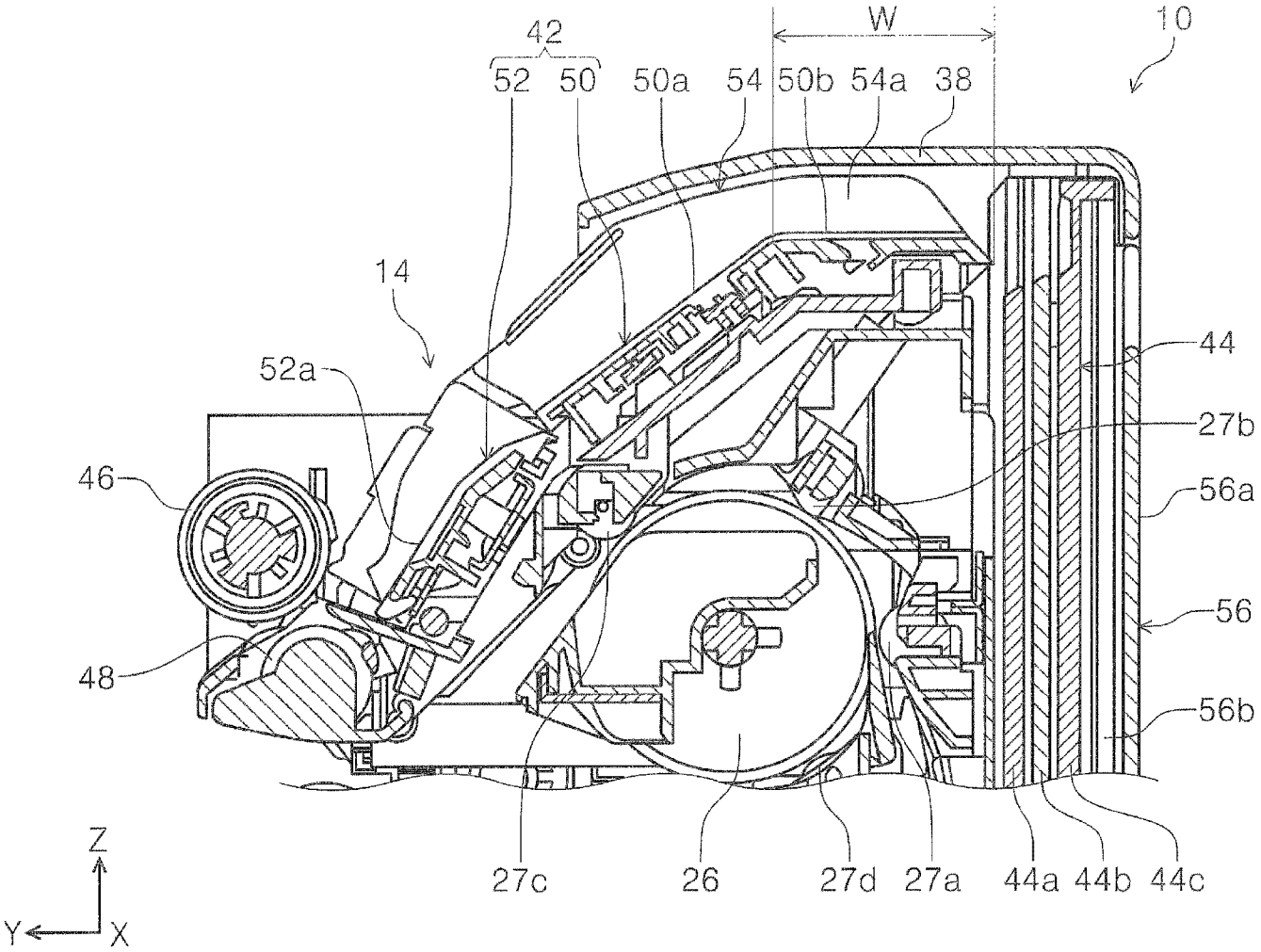
FIG. 5 is a side sectional view of a medium-feeding device according to the invention.
Figure 6:
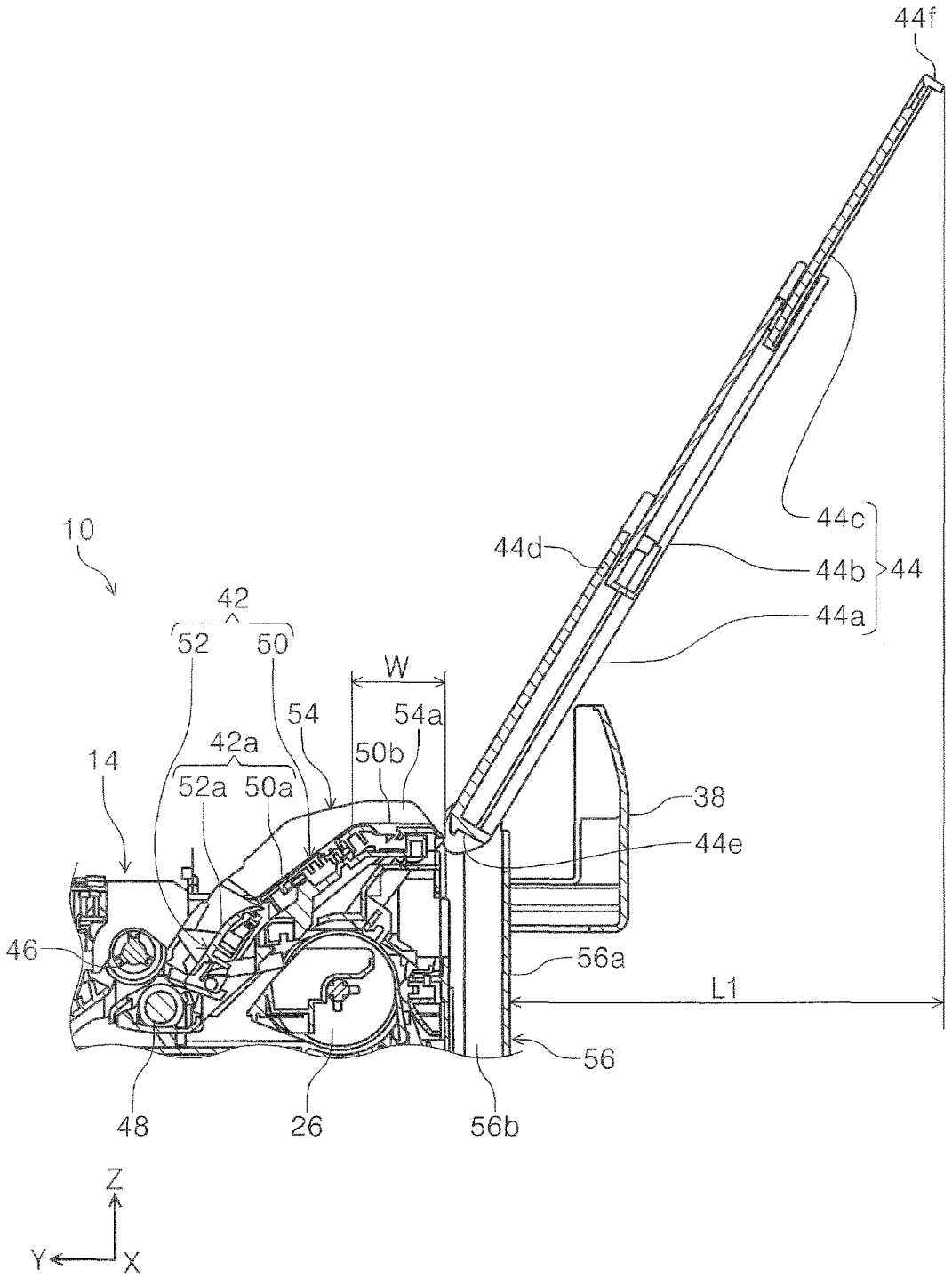
FIG. 6 is a side sectional view illustrating a state in which a second support portion according to the invention is pulled out.
Figure 7:
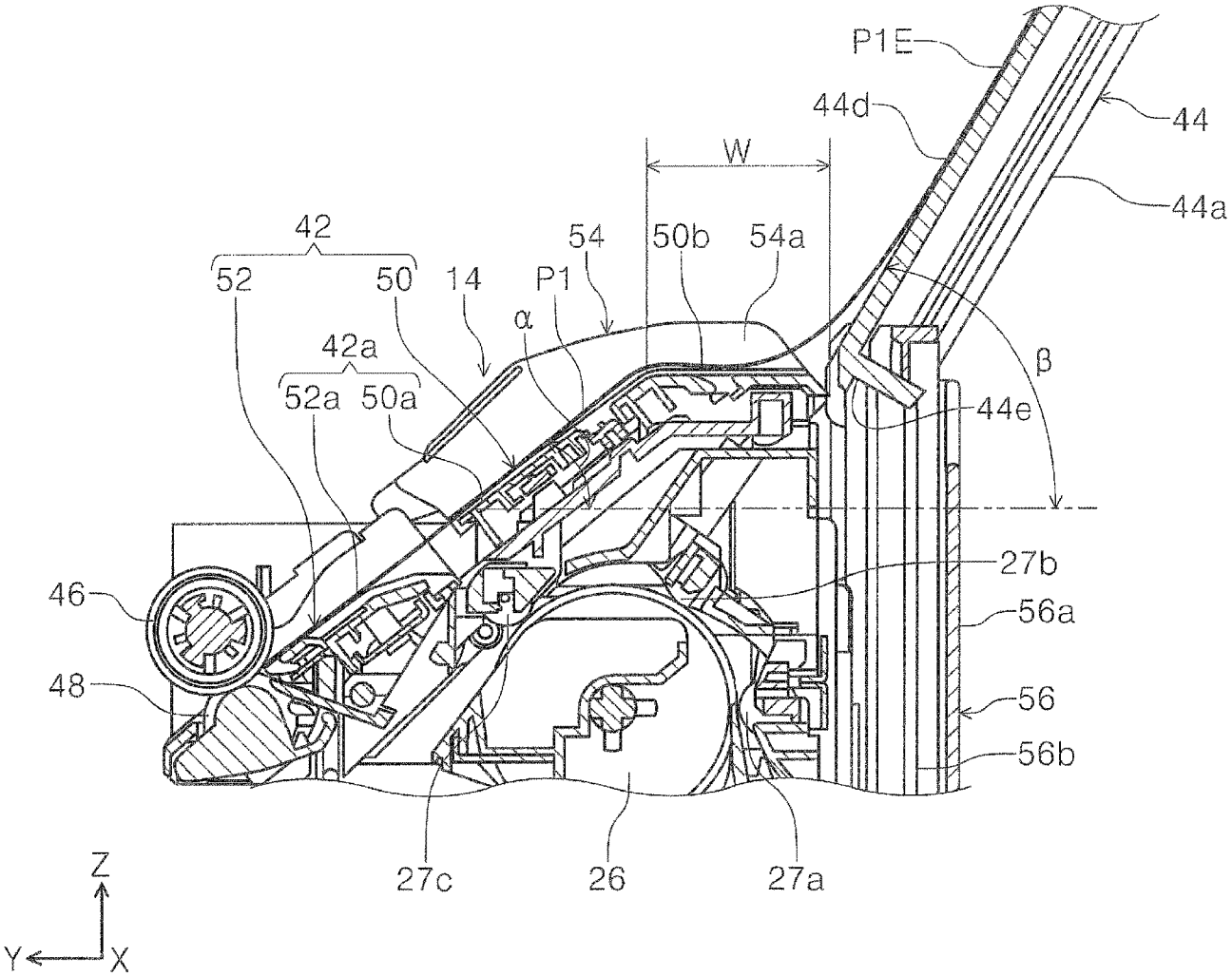
FIG. 7 is a side sectional view illustrating a state in which a first medium is set in the medium-feeding device.
Figure 8:
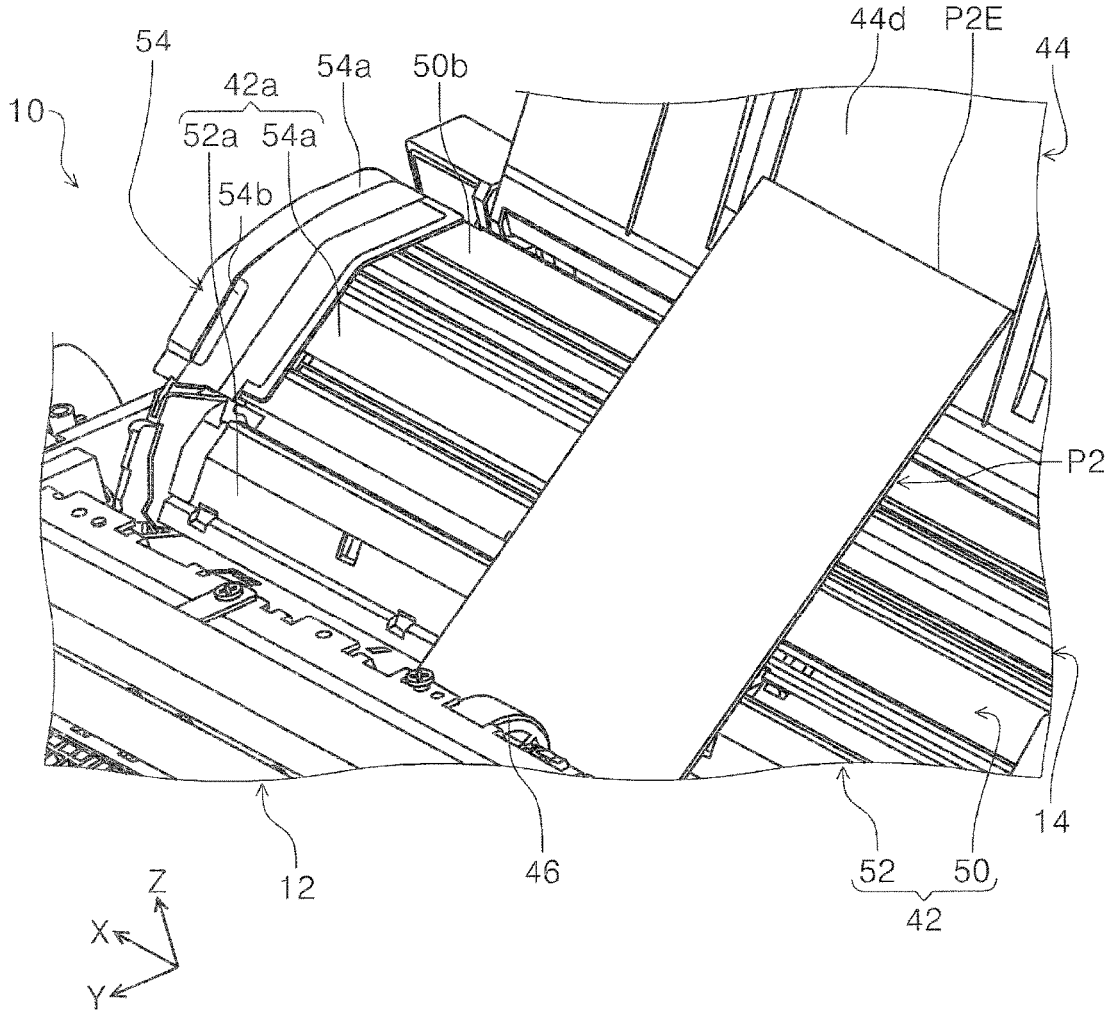
FIG. 8 is a perspective view illustrating a state in which a second medium is set in the medium-feeding device.
Figure 9:
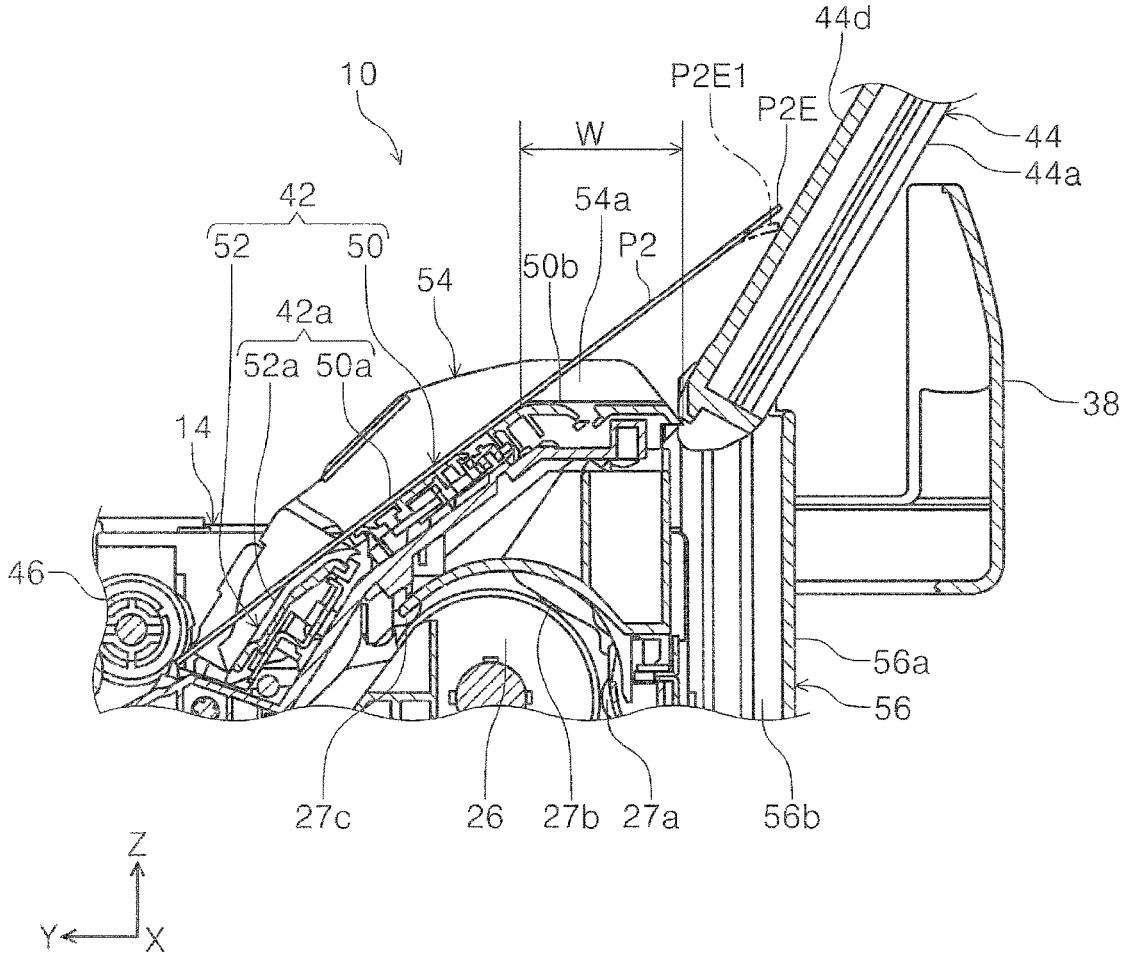
FIG. 9 is a side sectional view illustrating the state in which the second medium is set in the medium-feeding device.

FIG. 5 is a side sectional view of a medium-feeding device according to the invention. FIG. 6 is a side sectional view illustrating a state in which a second support portion according to the invention is pulled out. FIG. 7 is a side sectional view illustrating a state in which a first medium is set in the medium-feeding device. FIG. 8 is a perspective view illustrating a state in which a second medium is set in the medium-feeding device. FIG. 9 is a side sectional view illustrating the state in which the second medium is set in the medium-feeding device.

Figure 10:
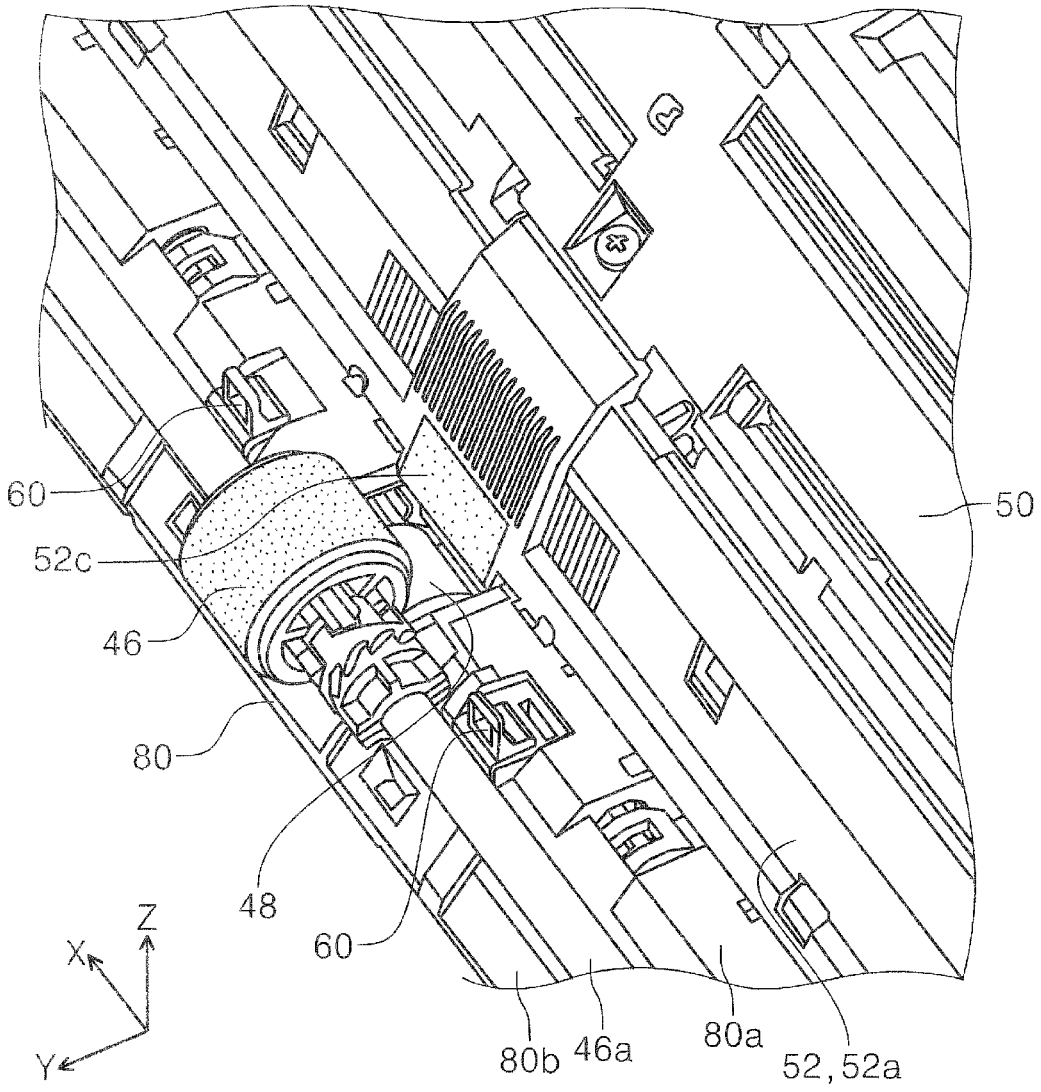
FIG. 10 is a perspective view of a main section of the medium-feeding device.
Figure 11A:
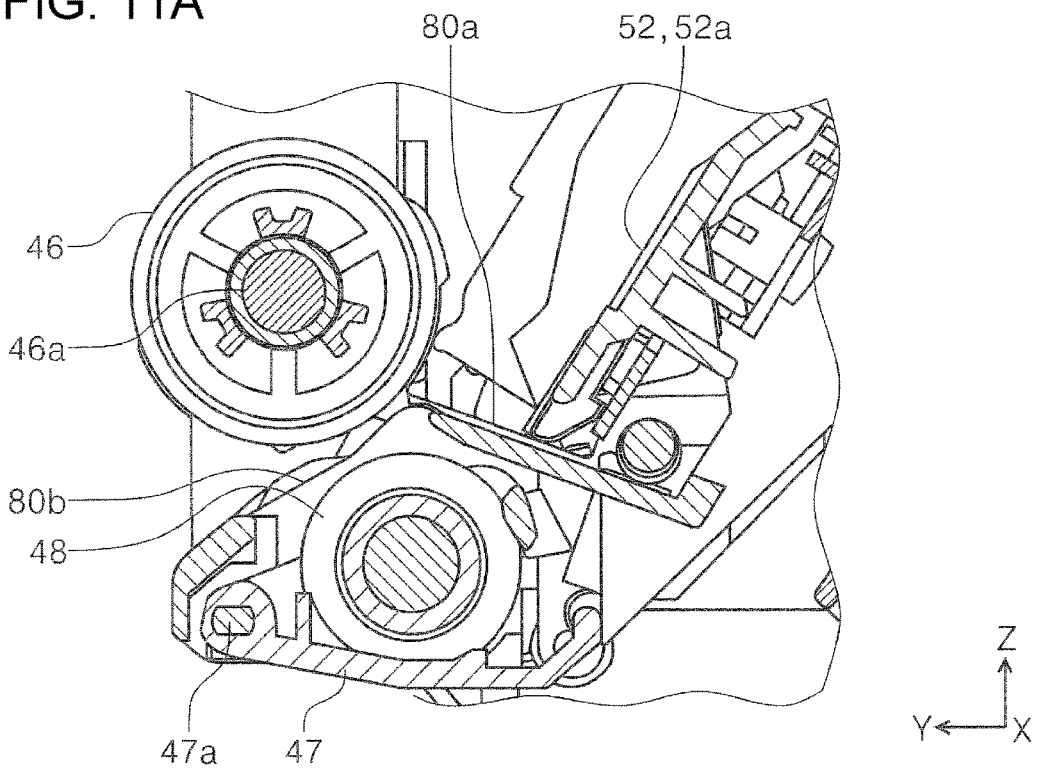
FIG. 11A is a side sectional view illustrating a feeding state of a separation roller.
Figure 11B:
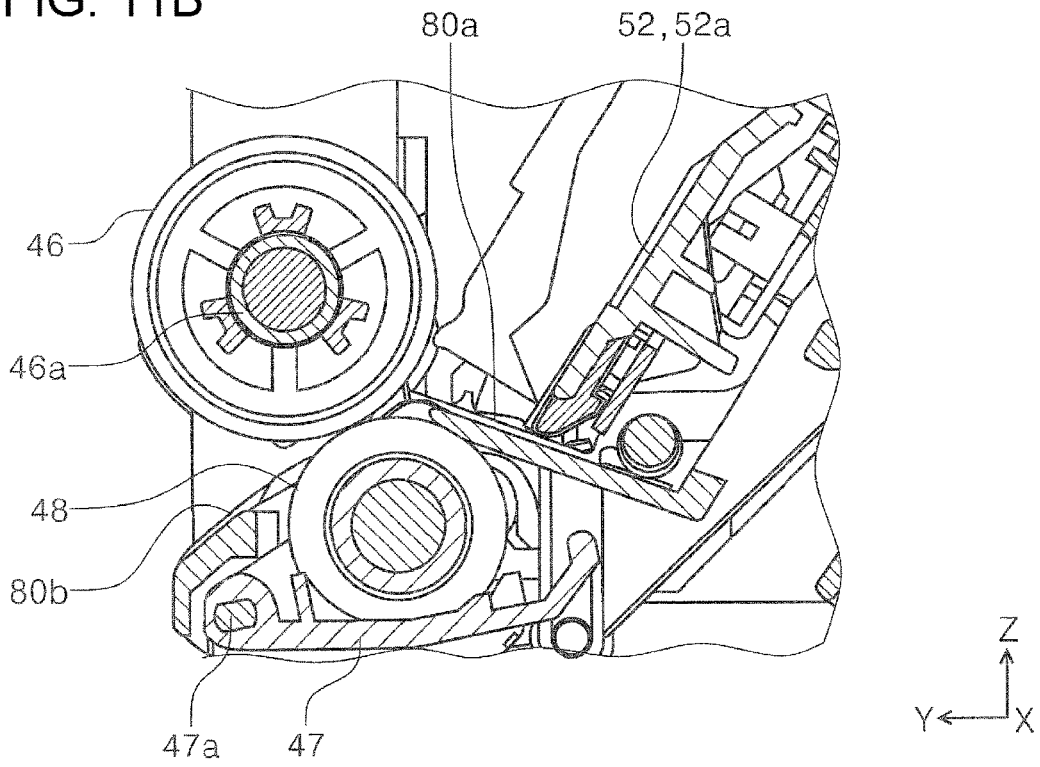
FIG. 11B is a side sectional view illustrating a nipping state of the separation roller.
Figure 12:
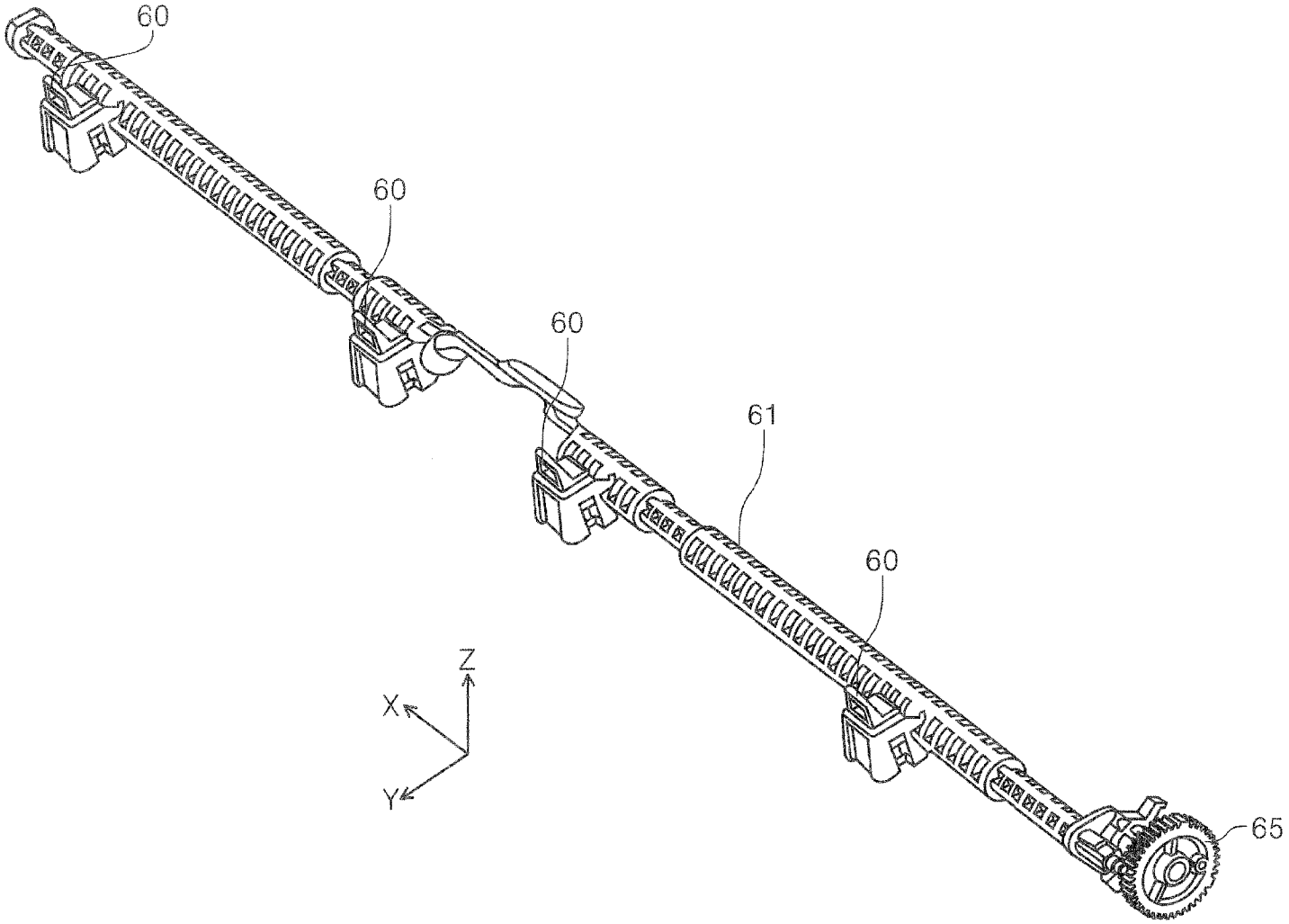
FIG. 12 is a perspective view of return members and a turning shaft.
Figure 13:
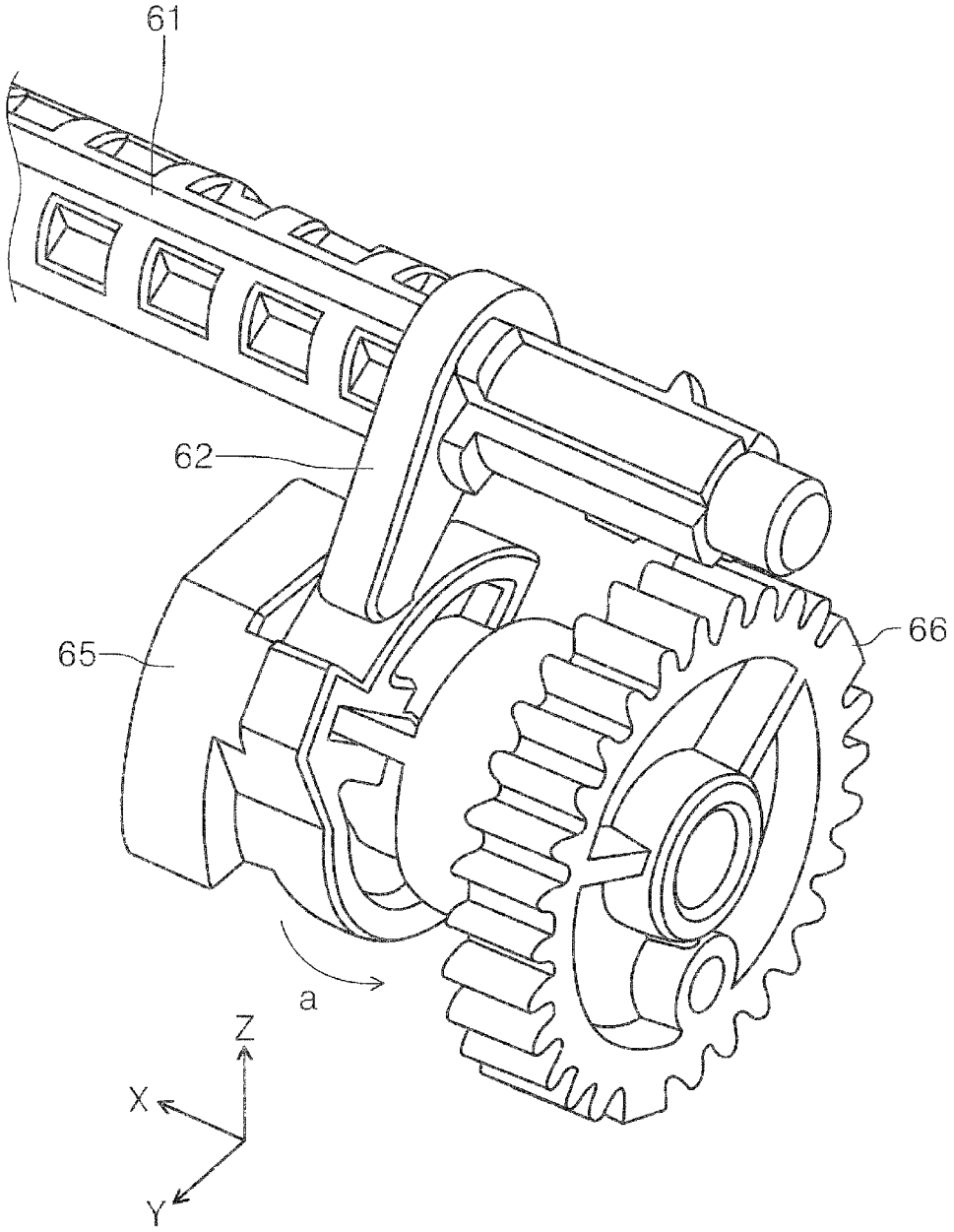
FIG. 13 is a perspective view of a cam that causes the return members to turn and a cam follower.
Figure 14:
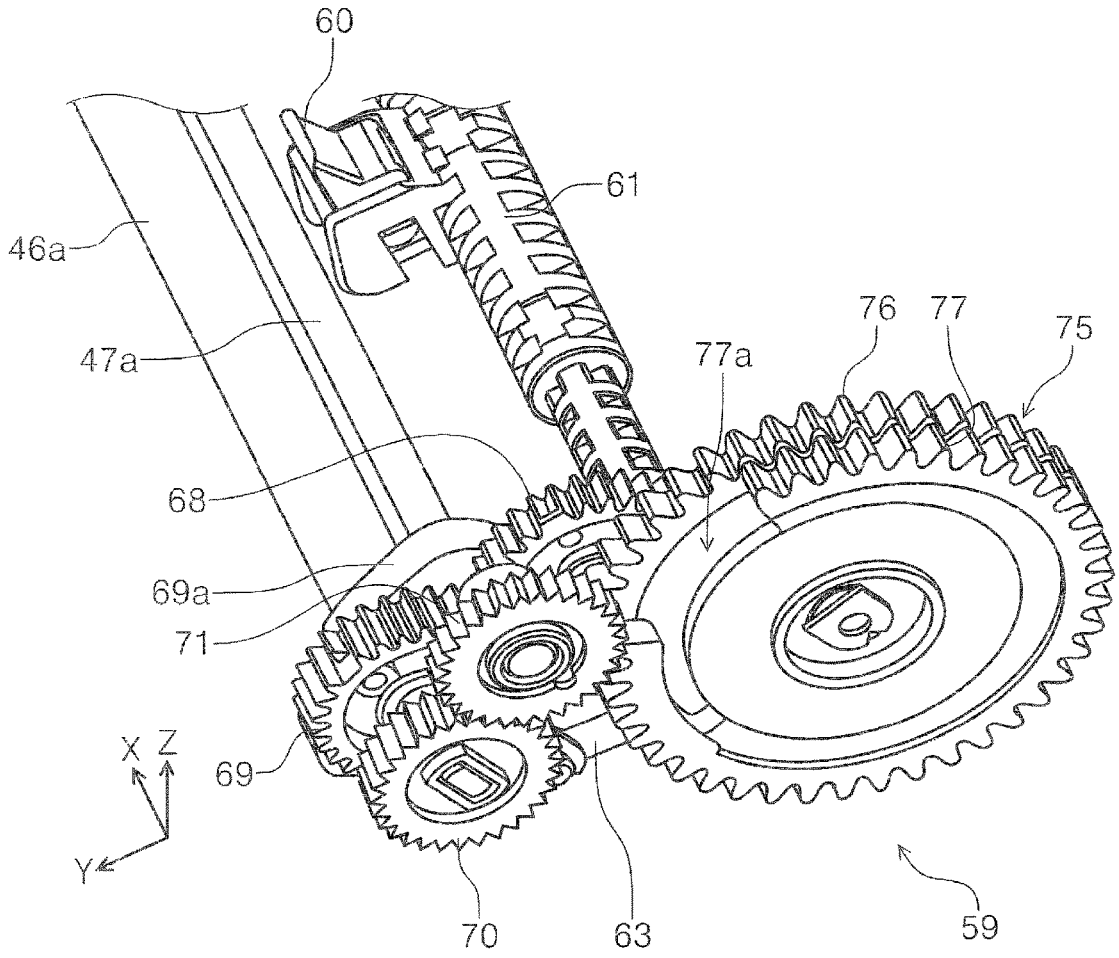
FIG. 14 is a perspective view of a motive power transmitting unit that transmits a driving force to a feed roller.
Figure 15:
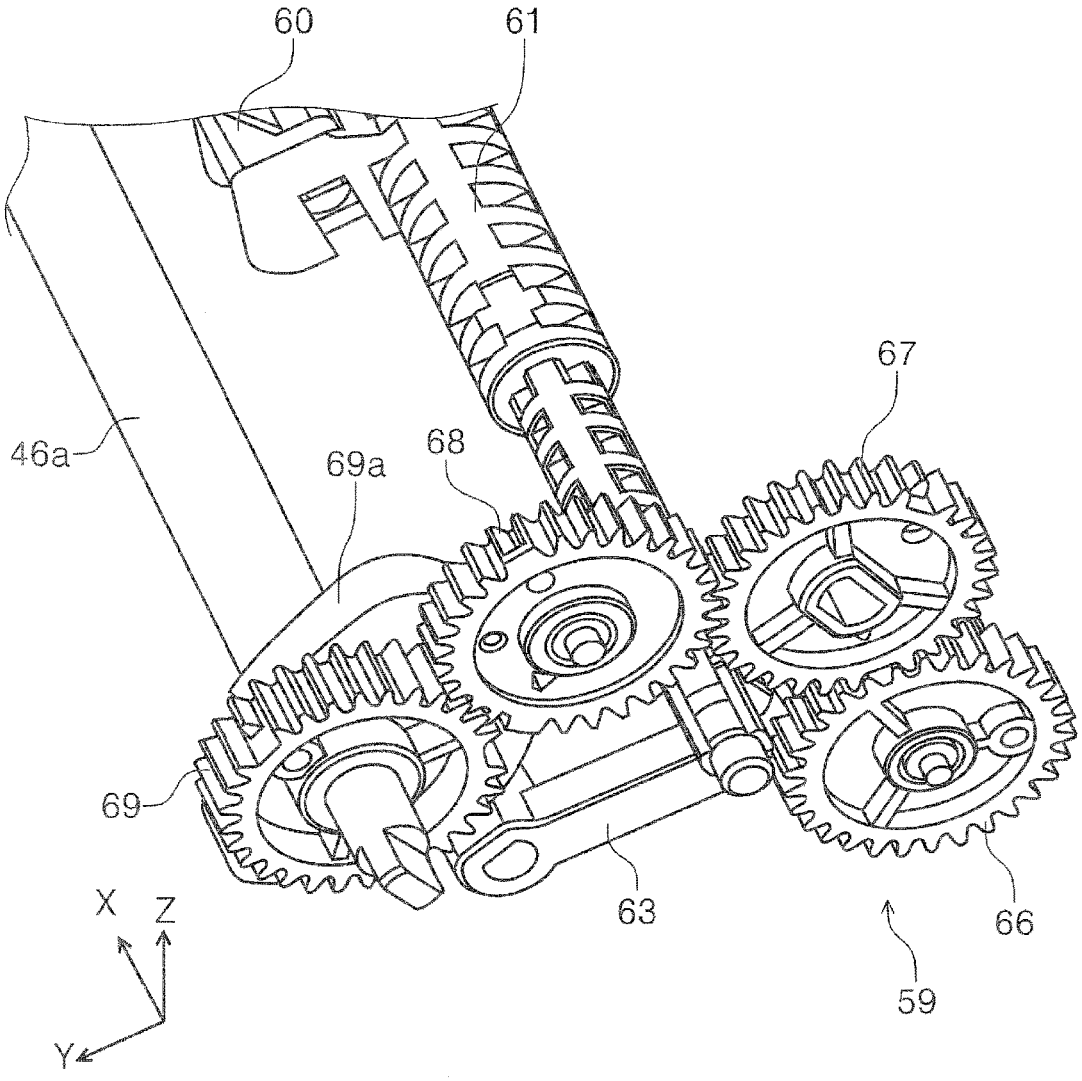
FIG. 15 is another perspective view of the motive power transmitting unit that transmits the driving force to the feed roller.

FIG. 10 is a perspective view of a main section of the medium-feeding device. FIG. 11A is a side sectional view illustrating a feeding state of a separation roller, and FIG. 11B is a side sectional view illustrating a nipping state of the separation roller. FIG. 12 is a perspective view of return members and a turning shaft. FIG. 13 is a perspective view of a cam that causes the return members to turn and a cam follower. FIGS. 14 and 15 each show a motive power transmitting unit that transmits a driving force to a feed roller. FIG. 15 is a view illustrating a state in which at least an element is removed from the configuration shown in FIG. 14.

Figure 16A:
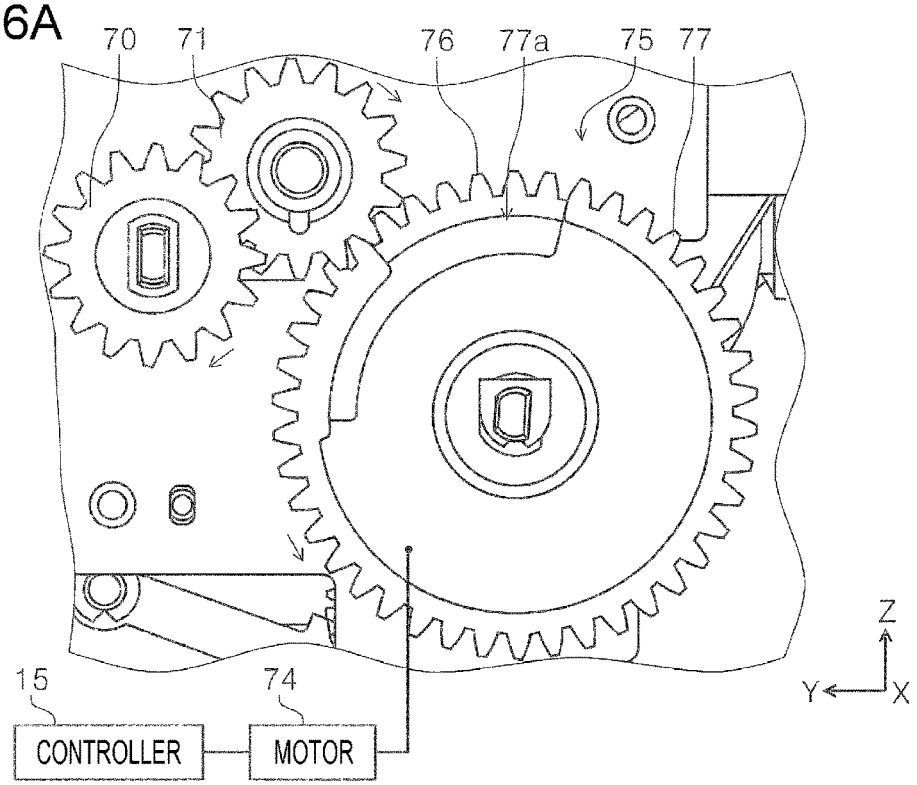
FIGS. 16A and 16B are front views of the motive power transmitting unit that transmits the driving force to the feed roller.
Figure 16B:
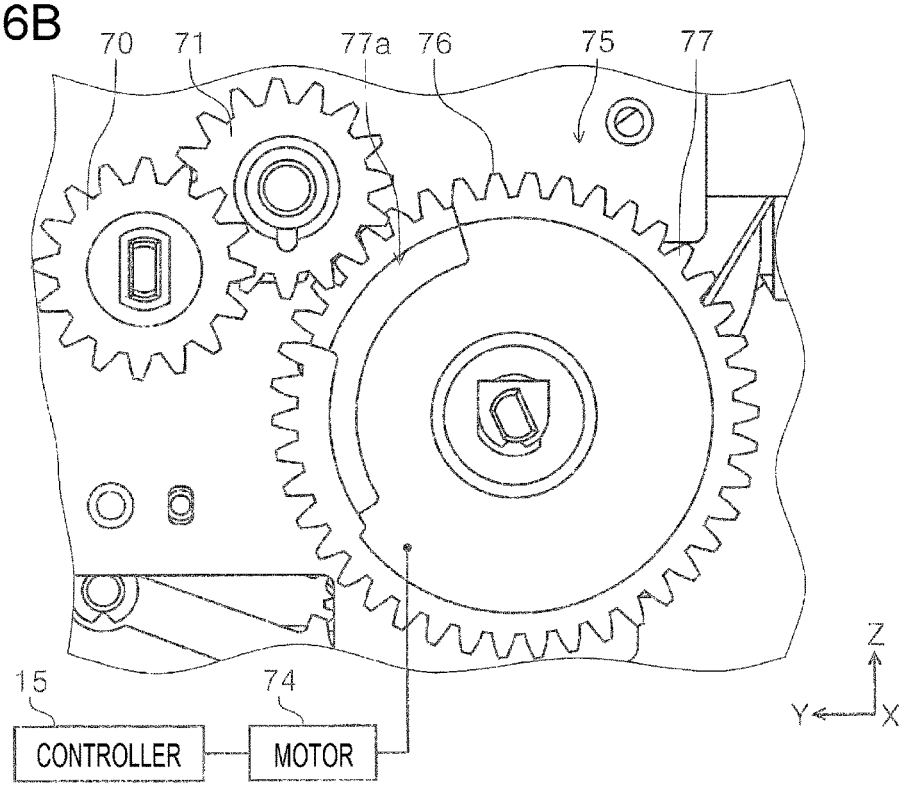
Figure 17:
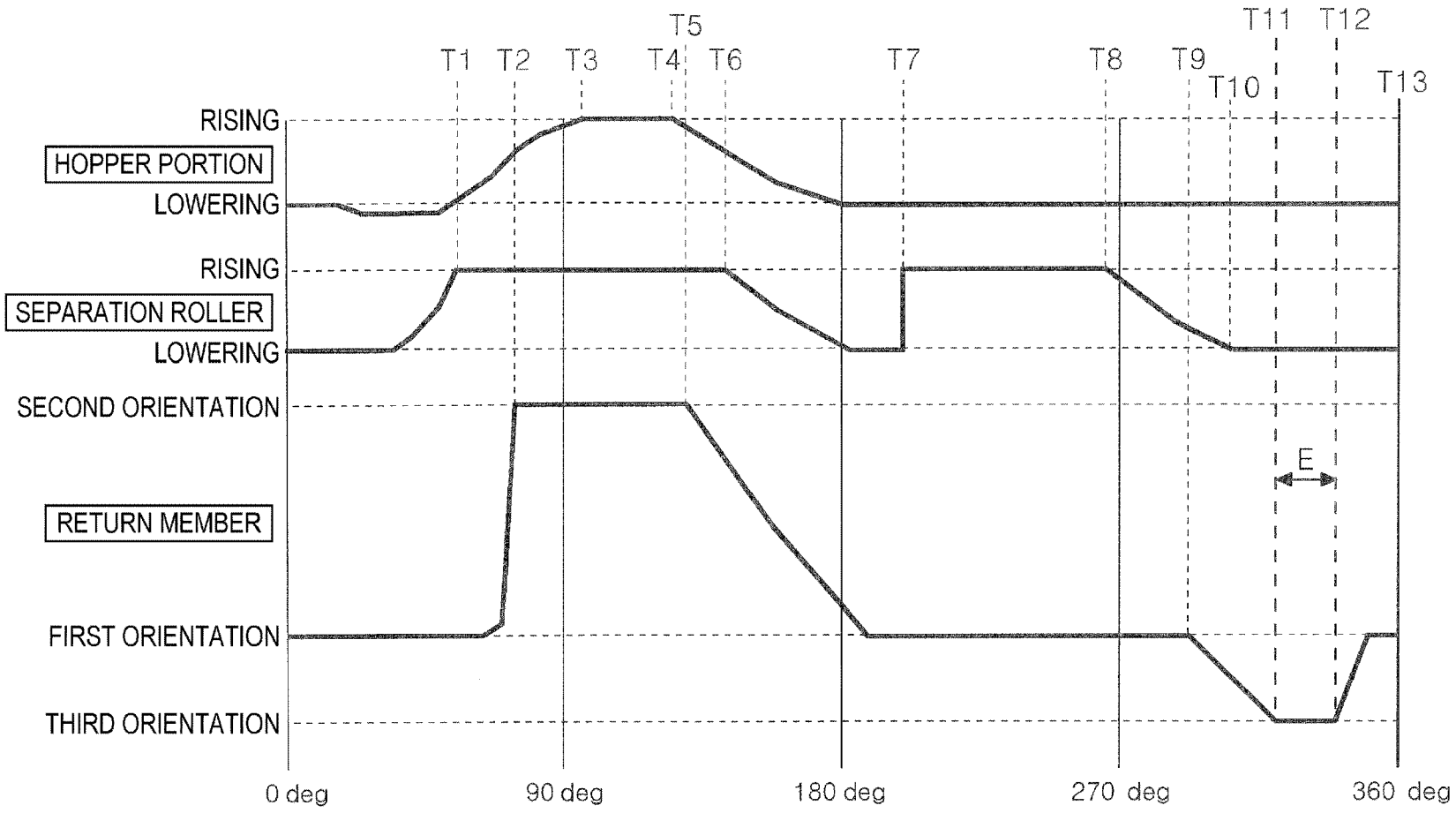
FIG. 17 is a timing chart showing operational transition of each of a hopper portion, the separation roller, and the return members.
Figure 20:
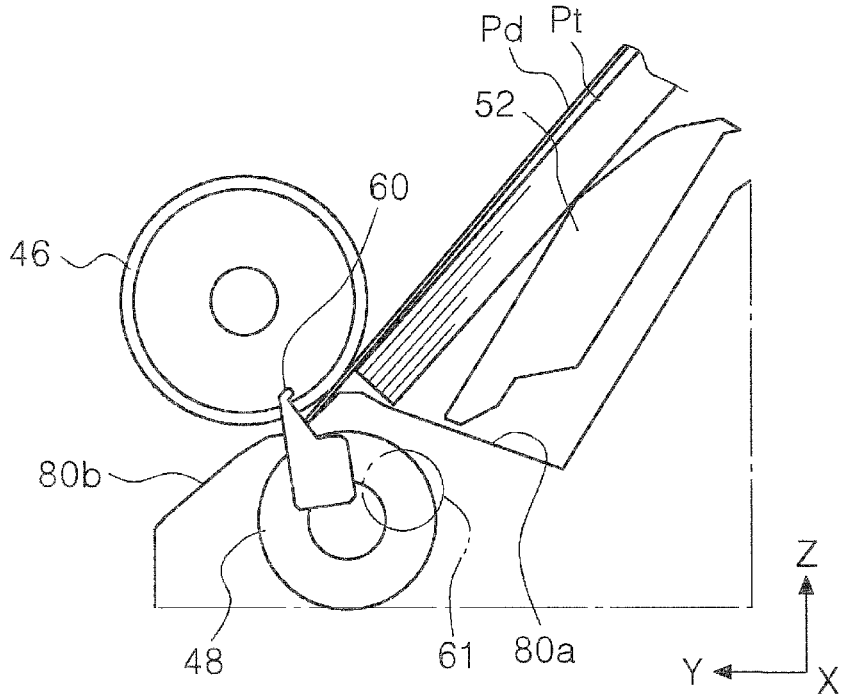
FIG. 20 is a schematic view illustrating a third operational state of the hopper portion, the separation roller, and the return member.
Figure 21:
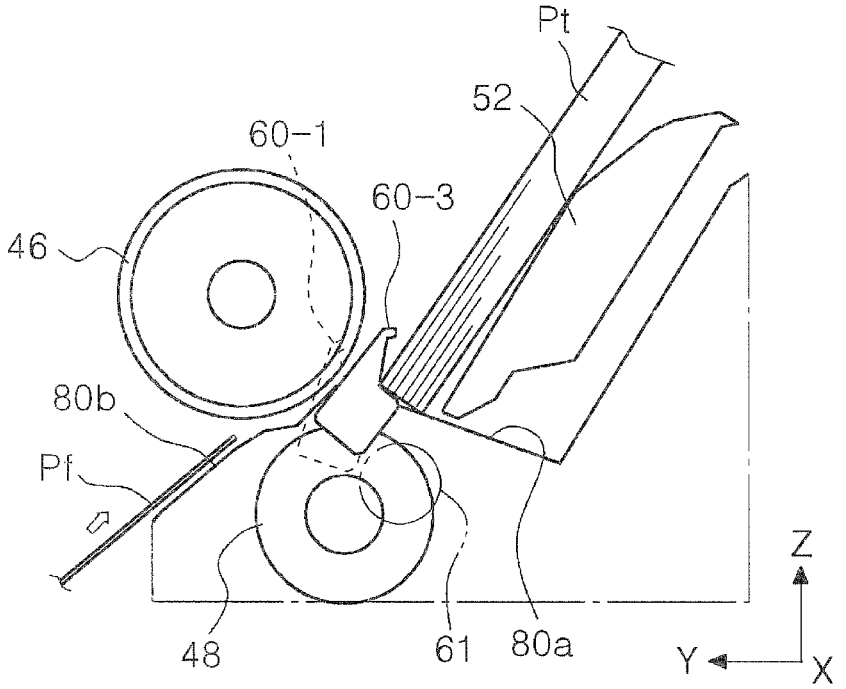
FIG. 21 is a schematic view illustrating a fourth operational state of the hopper portion, the separation roller, and the return member.
Figure 22:
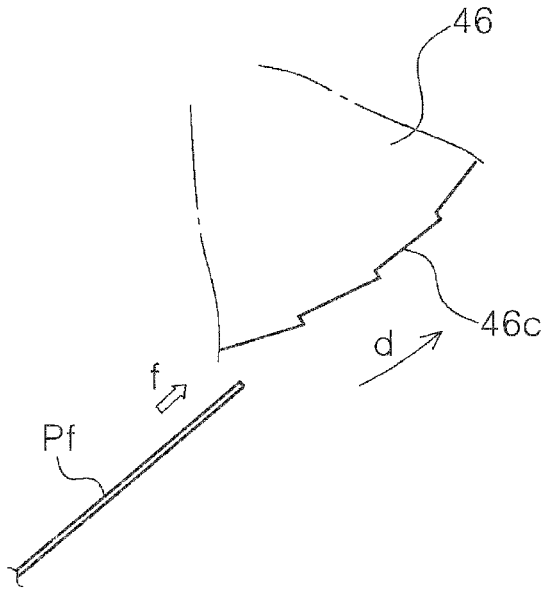
FIG. 22 is a view schematically illustrating a state of an outer circumferential surface of the feed roller.

FIGS. 16A and 16B are front views of the motive power transmitting unit that transmits the driving force to the feed roller. FIG. 17 is a timing chart showing operational transition of each of a hopper portion, the separation roller, and the return members. FIGS. 18, 19, 20, and 21 are schematic views respectively illustrating a first operational state, a second operational state, a third operational state, and a fourth operational state of the hopper portion, the separation roller, and one of the return members. FIG. 22 is a view schematically illustrating a state of an outer circumferential surface of the feed roller.

Note that the X-Y-Z coordinate system shown in each drawing indicates a width direction of a recording medium, that is, an apparatus width direction as an X-direction; a transport direction of the recording medium along the transport path in a recording apparatus, that is, an apparatus depth direction as a Y-direction; and an apparatus height direction as a Z-direction.

First, an overall configuration of a printer 10 will be described. Referring to FIGS. 1 and 2, the printer 10 is an ink jet printer, as an example of the recording apparatus. The printer 10 includes an apparatus body 12 and a medium-feeding device 14 disposed behind the apparatus body 12. An operation section 16 is disposed on the front side of the apparatus body 12. The operation section 16 includes operation units, such as a display panel and a switch. A discharge tray 18 is disposed on the −Z side of the operation section 16. The discharge tray 18 is switchable between a state (FIGS. 1 and 2) in which the discharge tray 18 is stored in the apparatus body 12 and a state (not shown) in which the discharge tray 18 is extended on the front side of the apparatus body 12 so as to project from the front surface of the apparatus.

The apparatus body 12 includes a medium-storage cassette 20 disposed on the −Z side of the discharge tray 18. The medium-storage cassette 20 stores the medium. In the first example, the medium-storage cassette 20 is detachable from the apparatus body 12 on the front side of the apparatus body 12. The medium-storage cassette 20 is capable of storing, for example, an A4 size medium.

With reference to FIG. 2, a medium-transport path 22 will be described. In FIG. 2, a double-dashed chain line P-1 shows a path from the medium-storage cassette 20 to the discharge tray 18 for transporting a medium along the medium-transport path 22. The apparatus body 12 includes a pickup roller 24, a reverse roller 26, a transport roller pair 28, a recording head 30 as a recording unit, and a discharge roller pair 32, which are disposed along the medium-transport path 22 in this order.

The pickup roller 24 is disposed on the +Z side of the medium-storage cassette 20 so as to be disposed on an arm member that is turnable with a turning shaft 34 as the pivot. The pickup roller 24 transports, along the medium-transport path 22, an uppermost medium of media stored in the medium-storage cassette 20 to a downstream side in the medium transport direction by coming into contact with the uppermost media stored in the medium-storage cassette 20.

Driven rollers 27*a*, 27*b*, 27*c*, and 27*d* (FIG. 5) are disposed around the reverse roller 26 so as to be rotatable by being driven by the reverse roller 26. The medium fed from the medium-storage cassette 20 is nipped by the reverse roller 26 and the driven rollers 27*a*, 27*b*, and 27*c*, sequentially, and curved to be reversed so that the media is transported to the transport roller pair 28 disposed on the downstream side in the medium transport direction. The transport roller pair 28 transports the medium transported by the reverse roller 26 to a region opposite the recording head 30. The recording head 30 is disposed on a lower portion of a carriage 36. The recording head 30 is capable of discharging ink in the −Z direction. The carriage 36 is capable of reciprocating in an X-axis direction in the apparatus body 12. The recording head 30 discharges ink onto the medium that has been transported by the transport roller pair 28 to perform recording on a recording surface of the medium.

The medium that has been subjected to recording is nipped by the discharge roller pair 32 disposed on the downstream side of the recording head 30 in the medium transport direction. The medium is then discharged onto the discharge tray 18 that projects from the front surface of the apparatus. Note that, in FIG. 2, the double-dashed chain line P-2 shows a medium-transport path in the medium-feeding device 14 disposed on the +Z side of the reverse roller 26.

Next, the medium-feeding device 14 will be described. Referring to FIGS. 1 and 3, a cover 38 is disposed above a −Y-side end portion of the apparatus body 12. The cover 38 is switchable between an open state (FIG. 1), in which the cover 38 is open relative to the apparatus body 12, and a closed state (FIG. 3), in which the cover 38 is closed relative to the apparatus body 12. Referring to FIG. 3, when the cover 38 is in the open state relative to the apparatus body 12, a feeding inlet 40 (FIG. 2) is in an open state, which enables a medium to be inserted through the feeding inlet 40 into the medium-feeding device 14.

Referring to FIGS. 4 to 7, the medium-feeding device 14 includes a first support portion 42 and a second support portion 44, which support the medium; a feed roller 46; and a separation roller 48. The first support portion 42 includes a medium support portion 50 positioned on an upstream side in the medium transport direction and a hopper portion 52 positioned on a downstream side in the medium transport direction. The medium support portion 50 has a support surface 50*a* and a connection surface 50*b*. The support surface 50*a* is inclined at an inclination angle α (FIG. 7) in a Y-axis direction, which is a horizontal direction. The connection surface 50*b* is connected to an upper end of the support surface 50*a* and extends in the Y-axis direction, which is the horizontal direction. Note that the connection surface 50*b* is formed as a flat surface extending in the Y-axis direction; however, the connection surface 50*b* is not limited thereto and may be an inclined surface inclined at an inclination angle smaller than the inclination angle α.

The hopper portion 52 has a support surface 52*a* that supports the medium. The hopper portion 52 is switchable between an orientation (FIG. 5) in which the support surface 52*a* is separated from the feed roller 46 and an orientation (FIG. 7) in which the support surface 52*a* is close to the feed roller 46. The hopper portion 52 is pivotable on the downstream side in the medium transport direction with the upstream side thereof in the medium transport direction as the pivot. The hopper portion 52 is urged toward the feed roller 46 by an urging member (not shown).

Referring to FIG. 7, when the hopper portion 52 is in a pushed-up orientation (feeding orientation) relative to the feed roller 46, the support surface 50*a* of the medium support portion 50 and the support surface 52*a* of the hopper portion 52 are in substantially equal states (inclination angle α) in terms of inclination angle relative to the Y-axis, which extends in the horizontal direction. The support surface 50*a* and the support surface 52*a* in such states constitute a first support surface 42*a*. The inclination angle α is set in the first example as a desirable angle for the medium to enter a nip position between the feed roller 46 and the separation roller 48. Note that the substantially equal states with the hopper portion 52 being in the pushed-up orientation (feeding orientation) relative to the feed roller 46 include, not only a state in which the inclination angles completely coincide with each other, but also a state in which a difference between the inclination angle of the support surface 50*a* and the inclination angle of the support surface 52*a* is tolerable within a range in which the inclination angle α of the medium supported by the first support surface 42*a* is maintained.

Referring to FIGS. 4 and 5, a pair of edge guides 54 extending between the first support surface 42*a* and the connection surface 50*b* are disposed on the first support portion 42. In the X-axis direction, the pair of edge guides 54 are movable in directions toward and away from each other.

Referring to FIG. 5, in a state in which the cover 38 is closed, an extending portion 54*a* of each edge guide 54 is positioned on the −Z side of the cover 38. Each extending portion 54*a* overlaps the connection surface 50*b* in the state. Thus, even when, for example, a user applies a pressure to the cover 38 in the −Z direction in the state in which the cover 38 is closed, the cover 38 is restricted in terms of displacement (flection) in the −Z direction by coming into contact, above the connection surface 50*b*, with the extending portions 54*a* of the edge guides 54.

Referring to FIGS. 5 and 6, the second support portion 44 is disposed on the −Y side of the first support portion 42. The second support portion 44 is switchable between a stored state (FIG. 5) and a pulled-out state (FIGS. 6 and 7). In the stored state, the second support portion 44 is stored in a −Y-side end portion 56*a* of a reverse unit 56. In the pulled-out state, the second support portion 44 is pulled out from the −Y-side end portion 56*a* of the reverse unit 56 and inclined at an inclination angle β in the Y-axis direction, which is the horizontal direction. The second support portion 44 is, for example, a multi-stage tray in the first example. Note that the second support portion 44 may be a single-stage tray instead of the multi-stage tray.

More specifically, the second support portion 44 includes a first tray 44*a*, a second tray 44*b*, and a third tray 44*c*. The first tray 44*a* and the second tray 44*b* are movable by sliding on each other. Similarly, the second tray 44*b* and the third tray 44*c* are also movable by sliding on each other. The length of the second support portion 44 is extendible in the medium transport direction by sliding the trays on each other. FIG. 6 shows the second support portion 44 in a state in which all three stages of the trays are pulled out; however, the second support portion 44 is usable in a state in which only one of the stages of the trays, that is, the first tray 44*a* is pulled out with the second tray 44*b* and the third tray 44*c* being stored in the first tray 44*a*.

The second support portion 44 in the pulled-out state forms a second support surface 44*d* that is inclined at the inclination angle β. The second support surface 44*d* is positioned on the upstream side of the first support surface 42*a* in the medium transport direction (medium feeding direction) and supports the medium in cooperation with the first support surface 42*a*. Note that these trays form support surfaces different from each other in terms of level by a degree corresponding to the thickness of each tray in a direction crossing a sliding direction of each tray; however, the first example will be described on the basis of these trays forming the same surface.

Referring to FIG. 7, when the second support portion 44 is in the pulled-out state, the first support surface 42*a* is inclined at the inclination angle α in the Y-axis direction, which is the horizontal direction, and the second support surface 44*d* is inclined at the inclination angle β in the Y-axis direction, which is the horizontal direction. The inclination angle β is larger than the inclination angle α in the first example. Thus, the second support surface 44*d* extending from a lower end portion 44*e* of the first tray 44*a* to an upper end portion 44*f* of the third tray 44*c* is inclined at an angle larger than the inclination angle of the first support surface 42*a*. Referring to FIG. 6, L1 is a Y-axis direction distance between the lower end portion 44*e* and the upper end portion 44*f* of the second support surface 44*d*.

The second support surface 44*d* is disposed at a position set back from the first support surface 42*a* in the Y-axis direction. The connection surface 50*b* is disposed between the first support surface 42*a* and the second support surface 44*d* in the Y-axis direction. The connection surface 50*b* connects the first support surface 42*a* and the second support surface 44*d* to each other by extending in the Y-axis direction, thereby forming a connection region W (FIGS. 6 and 7).

Referring to FIG. 7, a first medium P1 is indicated by a thick line. The first medium P1 is a medium, such as plain paper, having relatively low rigidity. FIG. 7 shows a state in which the first medium P1 is supported by the first support surface 42*a*. Referring to FIG. 7, when the first medium P1 is set on the first support portion 42 in the medium-feeding device 14, the first medium P1 is supported by the first support surface 42*a* with a trailing end PIE of the first medium P1 supported by the second support surface 44*d*. When the first medium P1 has lower rigidity, the first medium P1 is also supported by the connection surface 50*b* in addition to the first support surface 42*a* and the second support surface 44*d*. The first medium P1 in the first example has a length that is longer than at least the first support surface 42*a* in the medium transport direction and that enables the trailing end P1E thereof to be supported by the second support surface 44*d*. The first medium P1 is, for example, a medium of A4-size or larger, such as A3-size.

Next, with reference to FIGS. 8 and 9, a state in which a second medium P2 is set in the medium-feeding device 14 will be described. The second medium P2 in the first example is, for example, a medium having a length shorter than the first medium P1 in the medium transport direction. Specifically, the second medium P2 is a postcard or a medium having a length corresponding to a postcard size in the medium transport direction.

When the second medium P2 is set on the first support surface 42*a* in the medium-feeding device 14, the second medium P2 is supported by the support surface 50*a* of the medium support portion 50. As shown in FIG. 9, a trailing end P2E of the second medium P2 does not come into contact with the second support surface 44*d* and is not supported by the second support surface 44*d* because the length of the second medium P2 is shorter than the first medium P1 in the medium transport direction. As a result, the second medium P2 is in an orientation inclined at the inclination angle α and supported by the first support surface 42*a* because the second medium P2 takes an orientation similar to that of the support surface 50*a* of the medium support portion 50.

In the first example, the medium-feeding device 14 includes the connection region W disposed between the first support surface 42*a* and the second support surface 44*d* in the Y-direction to prevent the trailing end P2E of the second medium P2 from coming into contact with the second support surface 44*d*. For example, the length in the Y-direction of the connection surface 50*b* forming the connection region W is set such that the trailing end P2E of the second medium P2 set on the first support surface 42*a* does not come into contact with the second support surface 44*d*.

If the trailing end P2E of the second medium P2 comes into contact with the second support surface 44*d*, the second medium P2 may not take the orientation similar to that of each of the first support surface 42*a* and the second support surface 44*d* because the second medium P2 has high rigidity. As a result, the trailing end P2E may be raised, which causes the second medium P2 to be in an orientation inclined at an angle larger than the inclination angle α.

In this case, the angle of the second medium P2 may become larger than the inclination angle α, which is an angle desirable to enter the nip position between the feed roller 46 and the separation roller 48. Thus, it may be impossible to perform appropriate feeding; in particular, non-feeding may easily occur.

In contrast, the length of the connection surface 50*b* (connection region W) in the Y-direction is set in the first example such that the trailing end P2E of the second medium P2 supported by the first support surface 42*a* does not come into contact with the second support surface 44*d*; thus, it is possible to perform appropriate feeding because the second medium P2 is supported by the first support surface 42*a* at the inclination angle α and transported to the nip position between the feed roller 46 and the separation roller 48 at the desirable entry angle, even when the second medium P2 has high rigidity.

Moreover, when the trailing end P2E of the second medium P2 is, for example, in a state (deformed state, portion indicated by the double-dashed chain line P2E1 in FIG. 9) curved in the −Z direction toward the second support surface 44*d* side, the trailing end P2E may come into contact with the second support surface 44*d*. Even in such a case, the trailing end P2E1 is raised by the second support surface 44*d* by a smaller degree, and thus variation in the inclined orientation of the second medium P2 is suppressed. Therefore, it is possible to cause the second medium P2 to be inclined at an inclination angle closer to the inclination angle α, which makes it possible to perform appropriate feeding.

Next, with reference to FIGS. 10 to 22, return members 60, the separation roller 48, and the hopper portion 52 will be further described.

First, referring to FIG. 10, a base body of the medium-feeding device 14 is constituted by a frame 80. The frame 80 forms a leading end support surface 80*a* and a guide surface 80*b*. The leading end support surface 80*a* supports the leading end of the medium set in the medium-feeding device 14. The guide surface 80*b* guides, to the downstream side, the medium P to be fed.

Referring to FIG. 10, a holding pad 52*c* is disposed on the hopper portion 52.

As shown in FIGS. 11A and 11B, the separation roller 48 is supported by a separation roller holder 47. The separation roller 48 is disposed with predetermined rotational resistance being applied by a torque limiter (not shown).

The separation roller holder 47 is disposed so as to be pivotable on a pivot shaft 47*a*. The separation roller holder 47 pivots to switch between an orientation (FIG. 11A, hereinafter referred to as a lowered orientation), in which the separation roller 48 is separated from the feed roller 46 and an orientation (FIG. 11B, hereinafter referred to as a raised orientation) in which the separation roller 48 is in contact with the feed roller 46. The separation roller holder 47 is urged into the raised orientation by an urging member (not shown). The orientations are switched by a cam mechanism, which will be described later.

As shown in FIG. 10, each return member 60 is disposed in the vicinity of the nip position between the feed roller 46 and the separation roller 48 in a side view of a medium feeding path. As shown in FIGS. 10 and 12, the return members 60 (the number thereof is four in the present embodiment) are disposed with an appropriate interval therebetween in a sheet width direction. In the present embodiment, one of the return members 60 is disposed adjacent to a side of each of the feed roller 46 and the separation roller 48 and another one of the return members is disposed adjacent to another side of each of the feed roller 46 and the separation roller 48 in the sheet width direction.

The return members 60 are disposed on a turning shaft 61. As shown in FIG. 13, a cam follower 62 is disposed at one shaft end of the turning shaft 61, the cam follower 62 being engaged with a cam 65. The outer circumferential surface of the cam 65 is a cam surface having a non-uniform radius in the circumferential direction. The cam 65 rotates (arrow a direction in FIG. 13) to thereby move the cam follower 62, which causes the turning shaft 61 to pivot, that is, causes the return members 60 to pivot.

The cam 65 is integral with a gear 66. As shown in FIG. 15, a motive power is transmitted to the gear 66 from a gear 67. The gear 67 is integral with a compound gear 75 (FIG. 14). A motive power of a motor 74 (FIGS. 16A and 16B) is transmitted to a gear 76 constituting the compound gear 75. As shown in FIGS. 16A and 16B, the motor 74 is controlled by a controller 15 as a control unit. The controller 15 also controls, for example, the transport roller pair 28, the carriage 36, and the recording head 30, which are described above.

The gear 76 and a gear 77 constituting the compound gear 75 rotate together. The gear 77, however, differs from the gear 76 in that a toothless portion 77*a* is formed in a portion of the gear 77, as shown in FIG. 14 and FIGS. 16A and 16B. The gear 77 including the toothless portion 77*a* transmits a driving force to a gear 70 via a gear 71. The gear 70 is fixed to a shaft end of a feed roller shaft 46*a*. Thus, the driving force is transmitted to the feed roller 46 via the compound gear 75 and the gears 70 and 71. In other words, the compound gear 75 and the gears 70 and 71 constitute a motive power transmitting unit 59 that transmits the driving force from the motor 74, as a driving source, to driving objects, for example, the feed roller 46.

A gear 69 is disposed on the feed roller shaft 46*a* so as to be freely rotatable relative to the feed roller shaft 46*a*. That is, the gear 69 is individually turnable separately from the feed roller shaft 46*a*.

As shown in FIG. 15, the driving force is transmitted from the gear 67 to the gear 69 via a gear 68.

The gear 69 includes a cam portion 69*a* that is engaged with the hopper portion 52. The hopper portion 52 is pushed up by the urging member (not shown). The cam portion 69*a* rotates to thereby push down the hopper portion 52. Thus, the hopper portion 52 is switched between the raised orientation and the lowered orientation.

Referring to FIGS. 14 and 15, a cam follower 63 is fixed to a shaft end of the pivot shaft 47*a*, which is the pivot shaft of the separation roller holder 47. The cam follower 63 is engaged with a cam (not shown). The cam (not shown) is turned by turning the compound gear 75. As a result, the separation roller 48 is displaced between a raised position and a lowered position.

Accordingly, the rotation of the compound gear 75 causes the feed roller 46 to rotate, the separation roller 48 to move back and forth relative to the feed roller 46, the hopper portion 52 to pivot (rise and lower), and the return members 60 to pivot.

FIG. 17 shows operational transition of each of the hopper portion 52, the separation roller 48, and the return members 60 in one rotation (360° rotation) of the compound gear 75.

Figure 18:
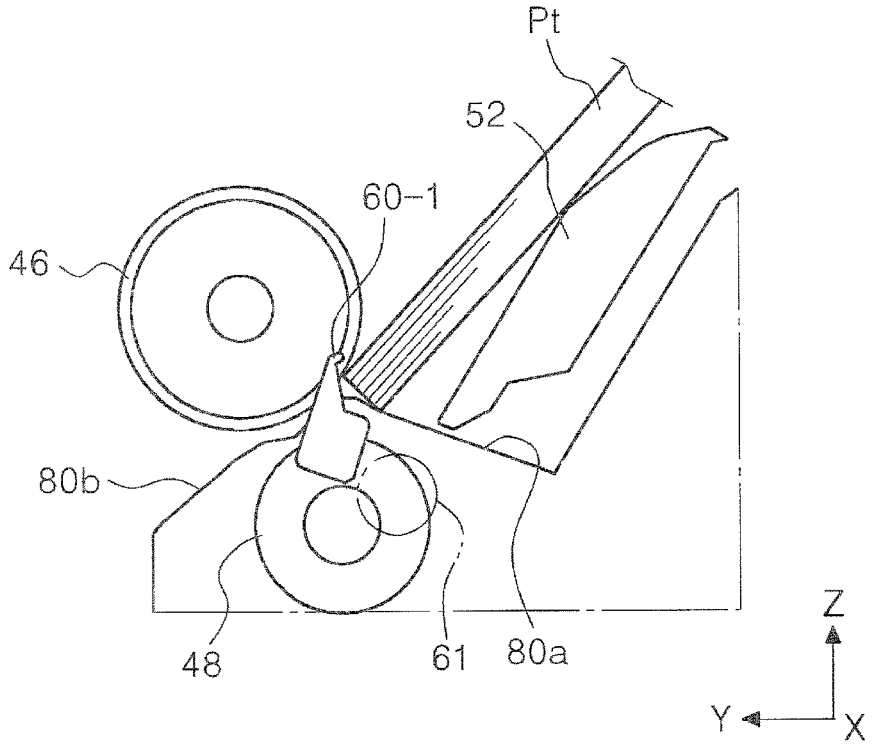
FIG. 18 is a schematic view illustrating a first operational state of the hopper portion, the separation roller, and one of the return members.

The orientation of the return members 60, in particular, will be described below in detail. Each return member 60 is switchable between a first orientation (FIG. 18) and a second orientation (FIG. 19) by turning the turning shaft 61. In the first orientation, a portion of each return member 60 overlaps the feed roller 46 in the side view of the medium feeding path. In the second orientation, each return member 60 is turned toward a downstream side in the medium feeding direction and does not overlap the feed roller 46. The return members 60 return the leading end of the medium to the upstream side of the nip position between the feed roller 46 and the separation roller 48, in other words, to the hopper portion 52 by changing the orientation thereof from the second orientation (FIG. 19) to the first orientation (FIG. 18). The first orientation (FIG. 18) is a basic orientation of the return members 60 during a non-feeding time. Thus, each return member 60 is in the first orientation (FIG. 18) in a feed stand-by state.

Figure 19:
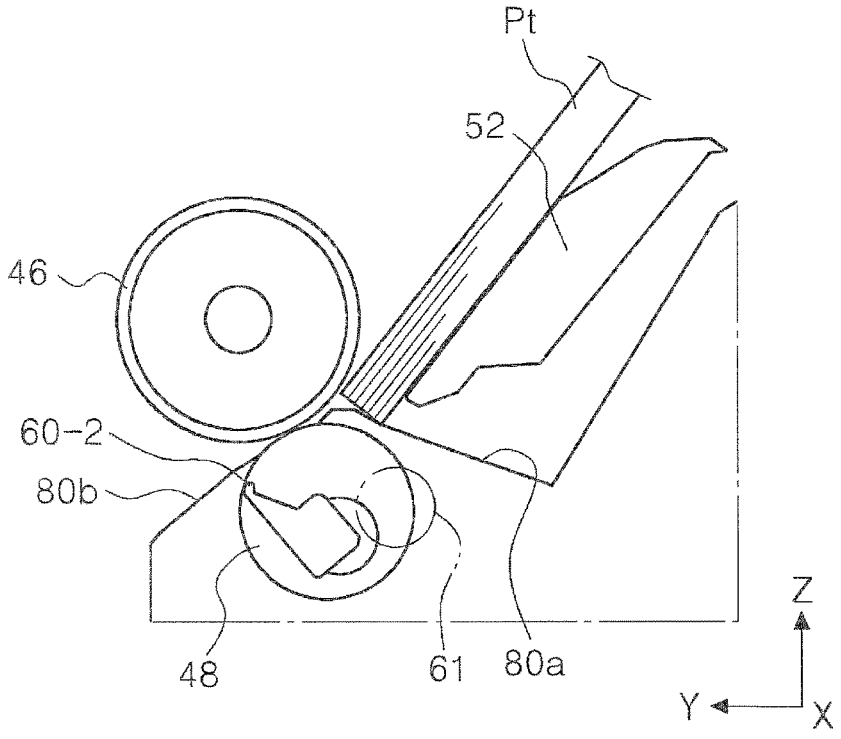
FIG. 19 is a schematic view illustrating a second operational state of the hopper portion, the separation roller, and the return member.

Referring to FIG. 18, a return member 60-1 is the return member 60 in the first orientation. Referring to FIG. 19, a return member 60-2 is the return member 60 in the second orientation. Referring to FIG. 21, a return member 60-3 is the return member 60 in a third orientation (described later). In FIG. 21, a silhouette of the return member 60-1, which is in the first orientation, is indicated by a dashed line.

Referring also to FIG. 17, before feeding is started, each element member is in the state shown in FIG. 18. In this state, the rotation of the compound gear 75 (FIG. 14) first causes the hopper portion 52 in a stand-by state to be slightly lowered, and then the separation roller 48 to complete (timing T1) contact with the feed roller 46.

Then, the hopper portion 52 starts rising and completes the rising at a timing T3.

Between the timing T1 and the timing T3, each return member 60 starts retraction (switching from the first orientation to the second orientation) and completes the retraction at a timing T2. FIG. 19 shows a state at the timing T2.

The rising of the hopper portion 52 causes the uppermost medium of a medium stack Pt set on the hopper portion 52 to come into contact with the feed roller 46. The uppermost medium is then fed to the downstream side due to the rotation of the feed roller 46.

When feeding has progressed, each return member 60 starts (timing T5) an orientation change from the second orientation to the first orientation, that is, starts a medium returning operation in order to return, to the upstream side, subsequent media that are fed together with the uppermost medium to be fed. In order for the return members 60 to perform the medium returning operation, the hopper portion 52 starts (timing T4) lowering, and the separation roller 48 also starts (timing T6) lowering. FIG. 20 shows a state around the timing T6. In FIG. 20, a medium Pd is the medium returned to the upstream side.

The separation roller 48 is raised again (timing T7) because the feed roller 46 continues the medium feeding operation, even when the return members 60 has completed the medium returning operation. After the separation roller 48 is raised and thereby causes the medium to be fed to be nipped by the feed roller 46 and the separation roller 48, the leading end of the medium is butted against the transport roller pair 28 disposed on the downstream side, and thereby skew is corrected. In this time, the transport roller pair 28 is driven in reverse.

After the skew correction is completed, the separation roller 48 starts (timing T8) lowering and completes the lowering at a timing T10.

Each return member 60 starts the orientation change from the second orientation (FIG. 18) to the third orientation (FIG. 21) at a timing T9, which is between the timing T8 and the timing T10. In the third orientation (FIG. 21), the return members 60 are raised toward the upstream side further than in the second orientation (FIG. 18).

After the return members 60 have been switched (timing T11) to the third orientation (FIG. 21), driving of the compound gear 75 (FIG. 14) is temporarily stopped. In such a state, the toothless portion 77*a* formed in the gear 77 constituting the compound gear 75 faces the gear 71, as shown in FIG. 16B. Transmission of driving force to the feed roller 46 is thereby cut, which causes the feed roller 46 to be in a freely rotatable state. FIG. 16A shows a state at the timing T11. In FIG. 16A, the rotation direction of each gear before the timing T11 is indicated by an arrow.

Until the driving of the compound gear 75 is restarted, and the gear 77 and the gear 71 mesh with each other again, the feed roller 46 is in the freely rotatable state. In this state (period E in FIG. 17), a printing operation onto media, a sheet discharging operation, and the like are performed.

In the state at the timing T11 shown in FIG. 17, the leading end of the medium to be fed has almost reached a position S (FIG. 2). Thus, in order to position the medium at a recording start position, the controller 15 controls the transport roller pair 28 to back-feed the medium. Referring to FIG. 21, a medium Pf is the medium to be back-fed.

During the back-feeding, each return member 60 is in the state (third orientation) shown in FIG. 21. Here, if the leading end of the medium stack Pt set in the medium-feeding device 14 is in contact (for example, the state in FIG. 18) with the feed roller 46, free rotation of the feed roller 46 may be obstructed, and moreover, the feed roller 46 may obstruct the back-feeding of the medium Pf. As a result, creasing and jamming of the medium Pf to be back-fed may occur.

In the present embodiment, however, each return member 60 is switchable to the third orientation (return member 60-3 in FIG. 21), in which each return member 60 is raised toward the upstream side further than in the first orientation (return member 60-1 in FIG. 21) in the side view of the medium feeding path. Therefore, it is possible to separate, as shown in FIG. 21, the set medium stack Pt from the feed roller 46 by switching the return members 60 to the third orientation.

The controller 15 controls the transport roller pair 28 (FIG. 2) to be driven in reverse when the return members 60 are in the third orientation (FIG. 21). Therefore, it is possible to appropriately back-feed the medium Pf because the set medium stack Pt is prevented from obstructing the free rotation of the feed roller 46.

Accordingly, it is possible to perform appropriate medium transporting, even in a configuration in which a space between the medium stack Pt and the feed roller 46 is small. Therefore, for example, it is possible to reduce the size of the apparatus, or it is possible to increase the number of media that can be set.

As described above with reference to, for example, FIG. 7, the second support portion 44 is disposed at a position set back from the first support portion 42, in particular, in the present embodiment. Thus, the set medium stack Pt is easily inclined backward, and the leading end of the medium stack Pt easily comes into contact with the feed roller 46; however, due to the aforementioned function of the return members 60, it is possible to prevent the medium stack Pt from obstructing the free rotation of the feed roller 46.

After the printing operation onto the medium and the discharge operation are completed, the controller 15 drives the compound gear 75 again to complete (timing T13 in FIG. 17) the one rotation (360° rotation) of the compound gear 75. Between the timing T12 and the timing T13, each return member 60 returns to the second orientation (FIG. 18) from the third orientation (FIG. 21).

The aforementioned timings T1 to T13 are time-series timings in this order.

The aforementioned configuration will be summarized as below. The printer 10 includes the hopper portion 52 as a medium support unit that supports the medium to be fed; the cylindrical feed roller 46 that feeds the medium supported by the hopper portion 52; the motive power transmitting unit 59 that transmits the driving force from the motor 74, which is the driving source of the feed roller 46, to the feed roller 46; and the separation roller 48 that separates the medium by nipping the medium between the separation roller 48 and the feed roller 46.

The printer 10 also includes the return members 60, the transport roller pair 28, and the controller 15. The return members 60 are switchable between the first orientation, in which a portion of each return member 60 overlaps the feed roller 46 in the side view of the medium feeding path, and the second orientation, in which each return member 60 is turned toward the downstream side in the medium feeding direction and does not overlap the feed roller 46 in the side view. The return members 60 return the leading end of the medium to the upstream side of the nip position between the feed roller 46 and the separation roller 48 by changing the orientation from the second orientation to the first orientation. The transport roller pair 28 is disposed on the downstream side of the feed roller 46 in the medium feeding direction and is rotatable in a normal direction and in a reverse direction. The controller 15 controls the transport roller pair 28.

The motive power transmitting unit 59 is capable of entering a rotation allowing state (FIG. 16B), in which free rotation of the feed roller 46 is allowed, by cutting torque transmission from the motor 74 to the feed roller 46. Each return member 60 is switchable to the third orientation, in which each return member 60 is raised toward the upstream side further than in the first orientation. The controller 15 back-feeds the medium by driving the transport roller pair 28 in reverse when each return member 60 is in the third orientation (FIG. 21) during positioning control, in which the transport roller pair 28 is driven in reverse to return the medium to the upstream side and positioned at the recording start position.

In the present embodiment, as shown in FIG. 21, each return member 60 in the third orientation does not overlap the feed roller 46 in the side view of the medium feeding path. Therefore, it is possible to reduce a transporting load applied by each return member 60 to the medium Pf (FIG. 21) to be back-fed.

In the present embodiment, as shown in FIG. 21, each return member 60 in the third orientation is moved to a position at which a path for back-feeding the medium is secured, in the side view of the medium feeding path. Therefore, it is possible to reduce the transporting load applied by each return member 60 to the medium Pf (FIG. 21) to be back-fed.

In the present embodiment, as shown in FIG. 18, the uppermost medium of the media set on the hopper portion 52 is allowed to come into contact with the feed roller 46 in a state in which a stacking height of the media set on the hopper portion 52 has reached the maximum stacking height and in which each return member 60 is in the first orientation. In other words, it is possible to reduce the space between the medium stack Pt and the feed roller 46, and thus, it is possible to increase the number of media that can be set and to reduce the size of the apparatus.

In the present embodiment, there is provided the pair of edge guides 54 that restrict an edge position of the medium supported by the hopper portion 52. Each edge guide 54 includes a protruding portion 54*b* that restricts the maximum stacking height of the media set on the hopper portion 52 (FIGS. 4, 5, and 7 to 9). Therefore, it is possible to prevent setting of the media of a quantity exceeding a limit and to thereby enable the return members 60 to provide an effect, without fail, of preventing the set medium stack Pt from coming into contact with the feed roller 46.

In the present embodiment, as shown in FIG. 6, the medium support portion includes the first support portion 42 and the second support portion 44. The first support portion 42 has the first support surface 42*a* that supports the medium in the inclined orientation. The second support portion 44 is positioned on the upstream side of the first support surface 42*a* in the medium feeding direction and has the second support surface 44*d*. The second support surface 44*d* supports the medium in cooperation with the first support surface 42*a*. An inclination angle of the second support surface 44*d* extending from the lower end portion to the upper end portion thereof is larger than an inclination angle of the first support surface 42*a*. The second support surface 44*d* is disposed at the position set back from the first support surface 42*a*. Thus, when a medium having high rigidity is set, a trailing end of the medium does not easily come into contact with the second support surface 44*d*, which enables the medium to be in an orientation more similar to that of the first support surface 42*a*. Therefore, it is possible to prevent the medium from having an inappropriate inclined orientation and to achieve appropriate feeding.

With respect to a medium having low rigidity, the enter angle thereof in a direction from the first support surface 42*a* toward the downstream side is appropriately regulated by the first support surface 42*a* because such a medium tends to be in an orientation similar to that of each of the first support surface 42*a* and the second support surface 44*d*. As a result, it is also possible to obtain a good feeding result.

Moreover, it is possible to reduce an installation space required on the rear side of the apparatus because the inclination angle of the second support surface 44*d* is larger than that of the first support surface 42*a*.

Therefore, according to the present embodiment, it is possible to form an appropriate orientation of the medium regardless of the rigidity of the medium and to reduce the installation space of the apparatus.

As shown in FIG. 22, in the present embodiment, a relative-movement direction (arrow f direction) of the medium Pf to be back-fed relative to an outer circumferential surface 46*c* of the feed roller 46 coincides with a direction (arrow d direction) in which the outer circumferential surface 46*c* of the feed roller 46 is ground. Specifically, in the present embodiment, the feed roller 46 is formed of, for example, ethylene propylene diene rubber (EPDM) and has an outer circumferential surface that has been subjected to grinding. The grinding forms forward directionality (arrow d direction) and reverse directionality in the circumferential direction on the outer circumferential surface. FIG. 22 schematically shows a state of the outer circumferential surface of the roller on which the forward directionality and the reverse directionality are formed due to grinding.

The medium Pf to be back-fed does not conflict with a surface state, which is formed due to the grinding, of the feed roller 46 because the relative-movement direction (arrow f direction) of the medium Pf to be back-fed relative to the outer circumferential surface 46*c* of the feed roller 46 and the direction (arrow d direction) in which the outer circumferential surface 46*c* of the feed roller 46 is ground coincide with each other. Therefore, it is possible to reduce the transporting load applied by the feed roller 46 to the medium Pf to be back-fed.

In the present embodiment, the invention is applied to the ink jet printer, as an example of the recording apparatus; however, the invention is also applicable to other common liquid ejecting apparatus.

The liquid ejecting apparatus is not limited to a recording apparatus such as a printer, a copier, or a facsimile machine that uses an ink jet-type recording head and discharges ink through the recording head to perform recording on a recording-object medium. The liquid ejecting apparatus includes an apparatus that ejects, instead of ink, a liquid for use corresponding to the intended use of the ink onto an ejection-object medium corresponding to the recording-object medium through a liquid ejecting head corresponding to the ink jet-type recording head.

In addition to the recording head, examples of the liquid ejecting head include a color material ejecting head for use in manufacturing a color filter of a liquid crystal display and the like; an electrode material (conductive paste) ejecting head for use in forming an electrode of an organic EL display, a surface light-emitting display (FED), and the like; a biological organic substance ejecting head for use in manufacturing biochips; and a sample ejecting heat as a precision pipette.

Note that the invention should not be limited to the aforementioned example and may be variously modified within the scope of the invention disclosed in the claims. Such modifications should be rightfully included in the scope of the invention.

The entire disclosure of Japanese Patent Application No. 2017-106726, filed May 30, 2017 is expressly incorporated by reference herein.

What is claimed is:

1. A recording apparatus comprising:

a medium support unit that supports a medium to be fed;

a cylindrical feed roller that feeds the medium supported by the medium support unit;

a motive power transmitting unit that transmits a driving force from a driving source of the feed roller to the feed roller;

a separation roller that separates the medium by nipping the medium between the separation roller and the feed roller;

a return member that is switchable between a first orientation and a second orientation, the first orientation being an orientation in which a portion of the return member overlaps the feed roller in a side view of a medium feeding path, the second orientation being an orientation in which the return member is turned toward a downstream side in a medium feeding direction and does not overlap the feed roller in the side view, the return member changing an orientation thereof from the second orientation to the first orientation and thereby returning a leading end of the medium to an upstream side of a nip position between the feed roller and the separation roller;

a transport roller that is disposed on the downstream side of the feed roller in the medium feeding direction, the transport roller being rotatable in a normal direction and in a reverse direction; and a control unit that controls the transport roller, wherein the motive power transmitting unit is capable of entering a rotation allowing state by cutting torque transmission from the driving source to the feed roller, the rotation allowing state being a state in which free rotation of the feed roller is allowed, wherein the return member is switchable to a third orientation, the third orientation being an orientation in which the return member is raised toward the upstream side further than in the first orientation, and wherein the control unit drives the transport roller in reverse when the return member is in the third orientation during positioning control that is a control in which the transport roller is driven in reverse to return the medium to the upstream side and position the medium at a recording start position.

2. The recording apparatus according to claim 1, wherein, in the side view of the medium feeding path, the return member in the third orientation does not overlap the feed roller.

3. The recording apparatus according to claim 1, wherein, in the side view of the medium feeding path, the return member in the third orientation is moved, when the positioning control is performed, to a position at which the return member does not obstruct a path used for returning the medium to the upstream side.

4. The recording apparatus according to claim 1, wherein, in a state in which a stacking height of media set on the medium support unit has reached a maximum stacking height and in which the return member is in the first orientation, an uppermost medium of the media set on the medium support unit is allowed to come into contact with the feed roller.

5. The recording apparatus according to claim 4, further comprising:

an edge guide that restricts a position of an edge of the medium that is supported by the medium support unit, wherein the edge guide includes a protruding portion that restricts the maximum stacking height of the media set on the medium support unit.

6. The recording apparatus according to claim 1, wherein the medium support unit includes a first support portion having a first support surface that supports the medium in an inclined orientation and a second support portion having a second support surface that supports the medium in cooperation with the first support surface, the second support portion being positioned on the upstream side of the first support surface in the medium feeding direction, and wherein an inclination angle of the second support surface extending from a lower end portion to an upper end portion thereof is larger than an inclination angle of the first support surface, the second support surface being disposed at a position set back from the first support surface.

7. The recording apparatus according to claim 1, wherein when the medium is back-fed, a relative-movement direction of the medium relative to an outer circumferential surface of the feed roller and a direction in which the outer circumferential surface of the feed roller is ground coincide with each other.

* * * * *